US008585426B2

(12) United States Patent
Zerebilov et al.

(10) Patent No.: US 8,585,426 B2
(45) Date of Patent: Nov. 19, 2013

(54) ELECTRICAL CONNECTOR INCLUDING LATCH ASSEMBLY

(75) Inventors: Arkady Y. Zerebilov, Lancaster, PA (US); Deborah A. Ingram, Etters, PA (US)

(73) Assignee: FCI Americas Technology LLC, Carson City, NV (US)

( * ) Notice: Subject to any disclaimer, the term of this patent is extended or adjusted under 35 U.S.C. 154(b) by 65 days.

(21) Appl. No.: 13/189,380

(22) Filed: Jul. 22, 2011

(65) Prior Publication Data

US 2012/0058665 A1 Mar. 8, 2012

Related U.S. Application Data

(60) Provisional application No. 61/368,033, filed on Jul. 27, 2010, provisional application No. 61/369,684, filed on Jul. 31, 2010, provisional application No. 61/416,220, filed on Nov. 22, 2010.

(51) Int. Cl.
*H01R 13/62* (2006.01)

(52) U.S. Cl.
USPC ..... 439/370

(58) Field of Classification Search
USPC ..... 439/370, 352, 357–358
See application file for complete search history.

(56) References Cited

U.S. PATENT DOCUMENTS

| | | | | |
|---|---|---|---|---|
| 5,062,803 | A | 11/1991 | Howard et al. | |
| 5,211,572 | A | 5/1993 | Comstock et al. | |
| 5,564,939 | A | 10/1996 | Maitani et al. | |
| 5,779,495 | A | 7/1998 | Dechelette et al. | |
| 6,447,170 | B1 | 9/2002 | Takahashi et al. | |
| 6,648,666 | B1 | 11/2003 | Wu | |
| 6,746,264 | B1 | 6/2004 | Branch et al. | |
| 6,758,699 | B1 | 7/2004 | Hwang et al. | |
| 6,786,653 | B1 * | 9/2004 | Hwang et al. | 385/92 |
| 6,953,356 | B2 | 10/2005 | Hisamatsu et al. | |
| 7,134,914 | B1 | 11/2006 | Wu | |
| 7,160,135 | B1 * | 1/2007 | Wu | 439/352 |

(Continued)

FOREIGN PATENT DOCUMENTS

| | | | |
|---|---|---|---|
| EP | 1477834 | A1 | 11/2004 |
| EP | 1855133 | A2 | 11/2007 |

*Primary Examiner* — Jean F Duverne
(74) *Attorney, Agent, or Firm* — Woodcock Washburn LLP

(57) ABSTRACT

An electrical connector includes a connector housing and at least one electrical contact supported by the connector housing, the at least one electrical contact configured to mate with a complementary electrical contact of a complementary electrical connector. The electrical connector further includes a latch assembly that includes an actuator and a latch body. The actuator has an actuator portion and at least one arm extending from the actuator portion. The arm includes a proximal end connected to the actuator portion, an opposed distal end, and an intermediate portion. The intermediate portion is retained by the connector housing at a location below the distal end. The latch body is connected to the connector housing so as to rotate about a pivot axis. The latch body includes a latch member at one side of the pivot axis, and a spring disposed at a second opposite side of the pivot axis. The spring provides a spring force that biases the latch member toward a latched position. The distal end of the at least one arm is attached to the latch body at the second opposite side of the pivot axis, such that an actuation force applied to the actuator causes the latch body to pivot against the spring force so as to urge the latch member to an unlatched position.

22 Claims, 20 Drawing Sheets

(56) References Cited

U.S. PATENT DOCUMENTS

| | | | | |
|---|---|---|---|---|
| 7,163,413 | B2 | 1/2007 | Murayama | |
| 7,281,937 | B2 | 10/2007 | Reed et al. | |
| 7,322,845 | B2 | 1/2008 | Regnier et al. | |
| 7,354,292 | B1 | 4/2008 | Lloyd et al. | |
| 7,371,117 | B2 | 5/2008 | Gailus | |
| 7,442,047 | B1 | 10/2008 | Schmidgall | |
| 7,445,484 | B2 | 11/2008 | Wu | |
| 7,527,522 | B2 | 5/2009 | Kondou | |
| 7,540,755 | B1 | 6/2009 | Wu | |
| 7,651,361 | B2 | 1/2010 | Henry et al. | |
| 7,666,023 | B2 | 2/2010 | Wu | |
| 7,736,171 | B2 | 6/2010 | Reed et al. | |
| 7,753,710 | B2 | 7/2010 | George | |
| 7,845,859 | B2 | 12/2010 | Roth et al. | |
| 8,241,045 | B2 * | 8/2012 | Reed et al. | 439/76.1 |
| 2005/0048830 | A1 | 3/2005 | Li et al. | |
| 2005/0233631 | A1 * | 10/2005 | Wu | 439/352 |
| 2007/0004282 | A1 | 1/2007 | Cohen et al. | |
| 2009/0221165 | A1 | 9/2009 | Buck et al. | |
| 2009/0291593 | A1 | 11/2009 | Atkinson et al. | |
| 2010/0144187 | A1 | 6/2010 | Chapel et al. | |

* cited by examiner

ELECTRICAL CONNECTOR INCLUDING LATCH ASSEMBLY

CROSS-REFERENCE TO RELATED APPLICATIONS

This application claims the benefit of U.S. Patent Application Ser. No. 61/368,033 filed on Jul. 27, 2010; U.S. Patent Application Ser. No. 61/369,684 filed on Jul. 31, 2010; and U.S. Patent Application Ser. No. 61/416,220 filed on Nov. 22, 2010, the disclosure of each of which is hereby incorporated by reference as if set for in its entirety herein.

BACKGROUND

Electrical connectors include a connector housing that carries a plurality of electrical contacts configured to electrically connect a pair of electrical components. For instance, the electrical contacts can electrically connect to a cable at one end, and can mate with a complementary electrical connector at a mating end, thereby placing the electrical connector in electrical communication with the cable. In some instances, for example when the complementary electrical connector is mounted onto a printed circuit board or backpanel, conventional electrical connectors include a latch that is couple to the connector housing, and configured to removably secure the electrical connector to the complementary electrical connector so as to prevent the electrical connectors from inadvertently becoming unmated.

Often, electrical connectors are place in electrical devices where physical space is limited. Accordingly, it is desirable to reliably secure the electrical connectors without substantially increase the footprint of the electrical connector.

SUMMARY

In accordance with one embodiment, an electrical connector includes a connector housing that defines mating interface and an opposed mounting interface disposed at a rear end of the connector housing. The electrical connector further includes at least one electrical contact supported by the connector housing, the at least one electrical contact configured to mate with a complementary electrical contact of a complementary electrical connector at the mating interface. The connector housing is configured to receive a cable assembly at the mounting interface so as to place the cable assembly in electrical communication with the at least one electrical contact. The electrical connector further includes a latch body supported by the connector housing and configured to actuate between a latched position and an unlatched position. The electrical connector further includes an actuator having at least one arm that is attached to the latch body arm, such that movement of the at least one arm in response to an applied actuation force causes the latch body actuate from the latched position to the unlatched position. The actuator further has an actuator portion that extends rearward with respect to the mounting interface, wherein the actuator portion further comprises a pair of grip tabs are configured to receive the actuation force. The grip tabs define a cable assembly-receiving gap that is sized to receive the cable assembly to which the electrical connector is mounted

BRIEF DESCRIPTION OF THE DRAWINGS

The foregoing summary, as well as the following detailed description of an example embodiment of the application, will be better understood when read in conjunction with the appended drawings, in which there is shown in the drawings an example embodiment for the purposes of illustration. It should be understood, however, that the application is not limited to the precise arrangements and instrumentalities shown. In the drawings.

DETAILED DESCRIPTION

Figure 1:
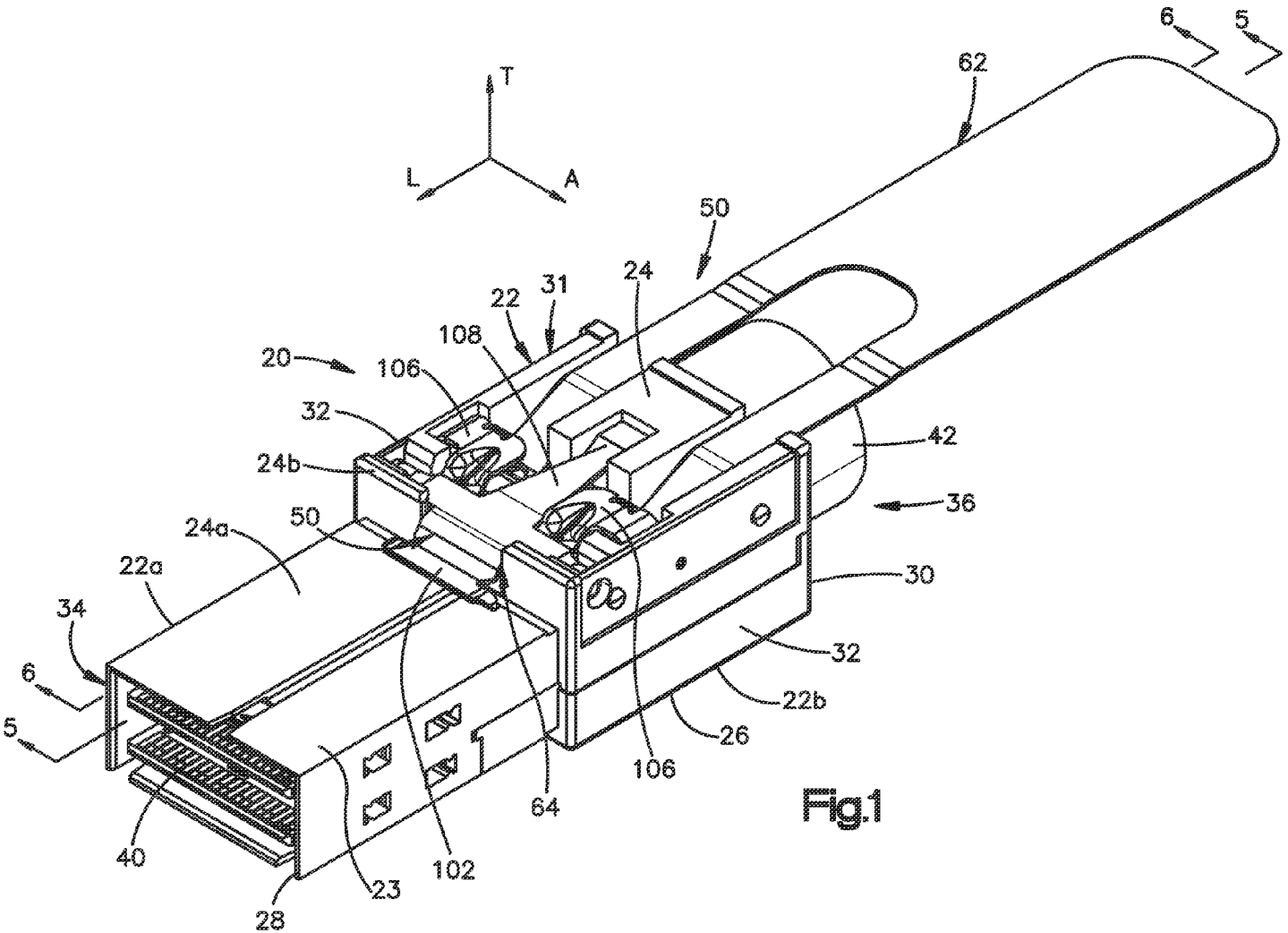
FIG. 1 is a perspective view of an electrical connector constructed in accordance with one embodiment.

Referring to FIG. 1, an electrical connector 20 provides a first electrical connector that is configured to mate with a second complementary electrical connector. The electrical connector 20 includes a connector housing 22 that defines a top end 24, an opposing bottom end 26, a front end 28, an opposing rear end 30, and opposed sides 32. The connector housing 22 may be made from any suitable dielectric material, such as a plastic, and can be injection molded or otherwise fabricated using any desired process. The opposed sides 32 are spaced apart along a lateral direction A, the front end rear ends 28 and 30 are spaced apart along a longitudinal direction L that is substantially perpendicular with respect to the lateral direction A, and the top and bottom ends 24 and 26 are spaced apart along a transverse direction T that is substantially perpendicular with respect to the lateral direction A and the longitudinal direction L. In accordance with the illustrated embodiment, the transverse direction T is oriented vertically, and the longitudinal and lateral directions L and A are oriented horizontally, though it should be appreciated that the orientation of the electrical connector 20 may vary during use.

The connector housing 22 defines a first or front housing portion 22*a* and a second or rear housing portion 22*b* that is disposed longitudinally behind the front housing portion 22*a*. The front housing portion 22*a* can include a shroud 23 that surrounds at least one electrical contact such as a plurality of electrical conductors or contacts 40. The shroud 23 defines at least one surface, such as an upper surface 24*a* that is inwardly recessed with respect to the upper surface 24*b* of the rear housing portion 22*b* along the transverse direction. The connector housing 22 defines a mating interface 34 at the front portion 22*a* that is configured to mate with the complementary electrical connector, and an opposed mounting interface 36 at the rear portion 22*b* that is configured to mate with a complementary electrical component. In particular, the shroud 23 is configured to interface with a complementary connector housing of the complementary electrical so as to place the electrical contacts 40 in electrical communication with complementary electrical contacts of the complementary electrical connector. In accordance with the illustrated embodiment, the shroud 23 is configured to be received in the complementary connector housing of the complementary electrical connector. The electrical connector 20 includes a latch assembly 50 that is configured to releasably lock the connector housing 22 to the complementary connector housing of the complementary electrical connector to which the electrical connector 20 is mated. In accordance with the illustrated embodiment, the latch assembly 50 is supported by the rear housing portion 22*b*, and extends longitudinally forward to the front housing portion 22*a*. Thus, the rear housing portion 22*b* can be said to define a latch support body 31 that supports the latch assembly 50.

Figure 12:
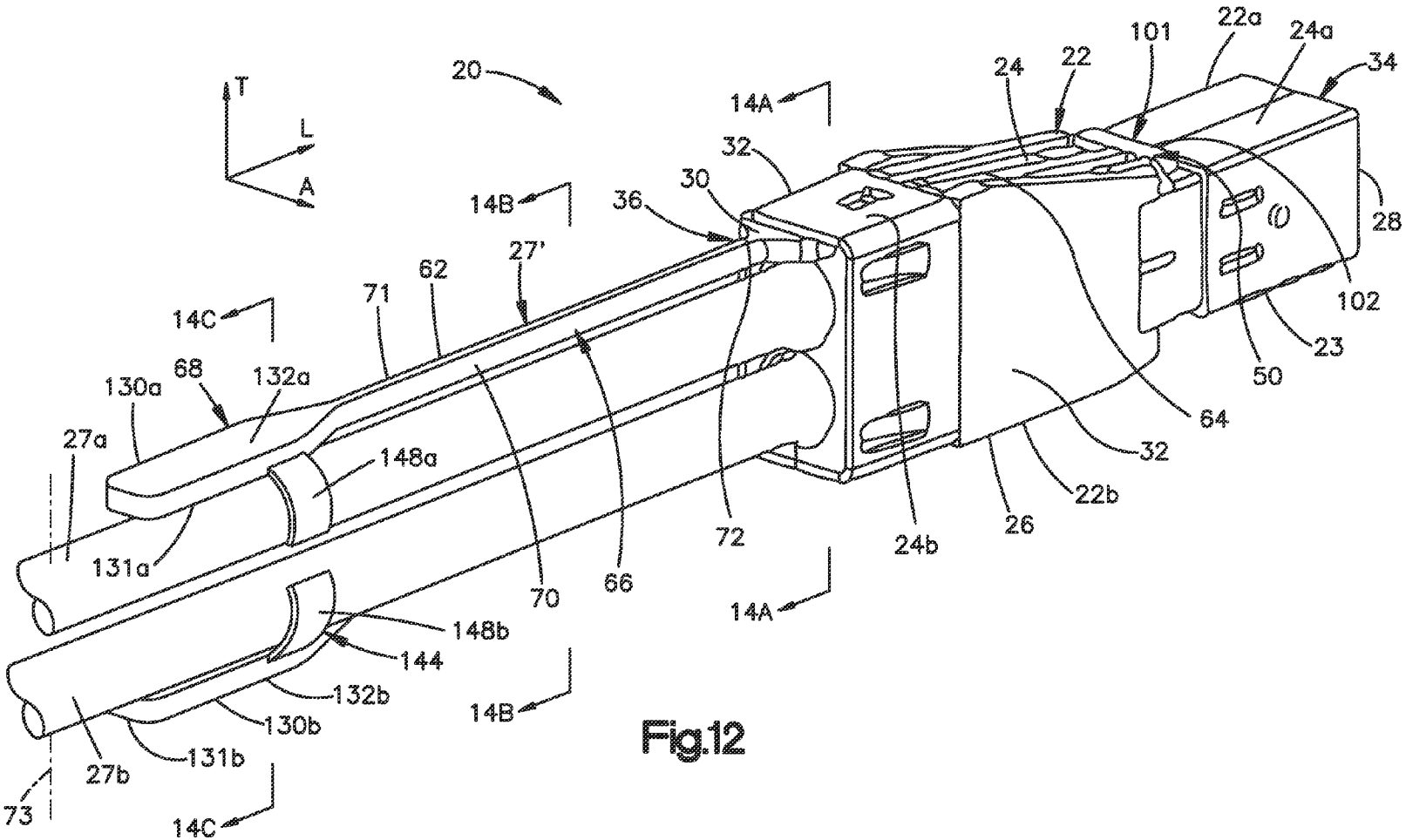
FIG. 12 is a schematic perspective view of the electrical connector as illustrated in FIG. 1, but including a mounting interface configured to receive a pair of cables and including an actuator constructed in accordance with an alternative embodiment.
Figure 13A:
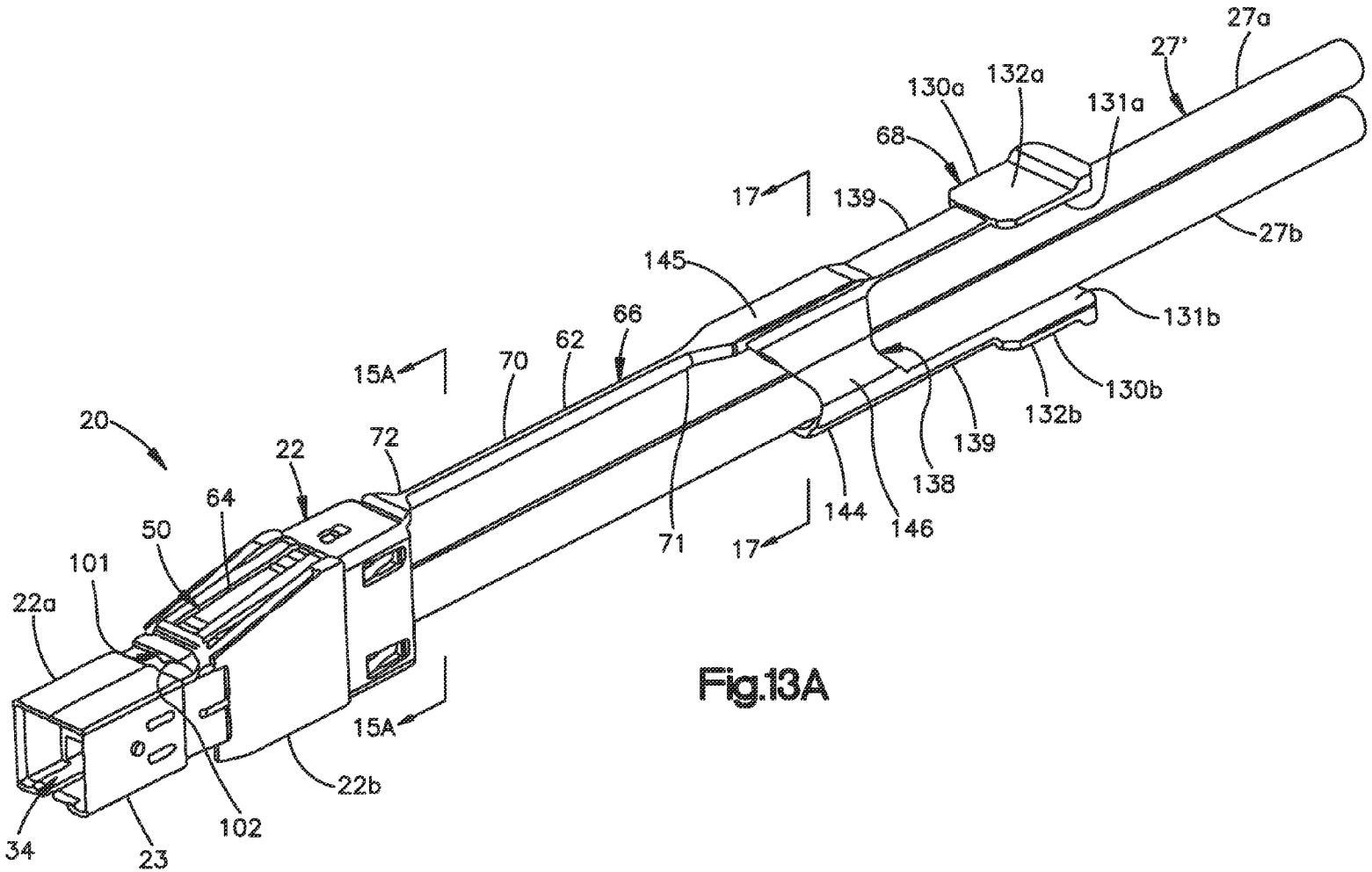
FIG. 13A is another perspective view of the electrical connector illustrated in FIG. 12, but including a grip portion constructed in accordance with another embodiment.
Figure 13B:
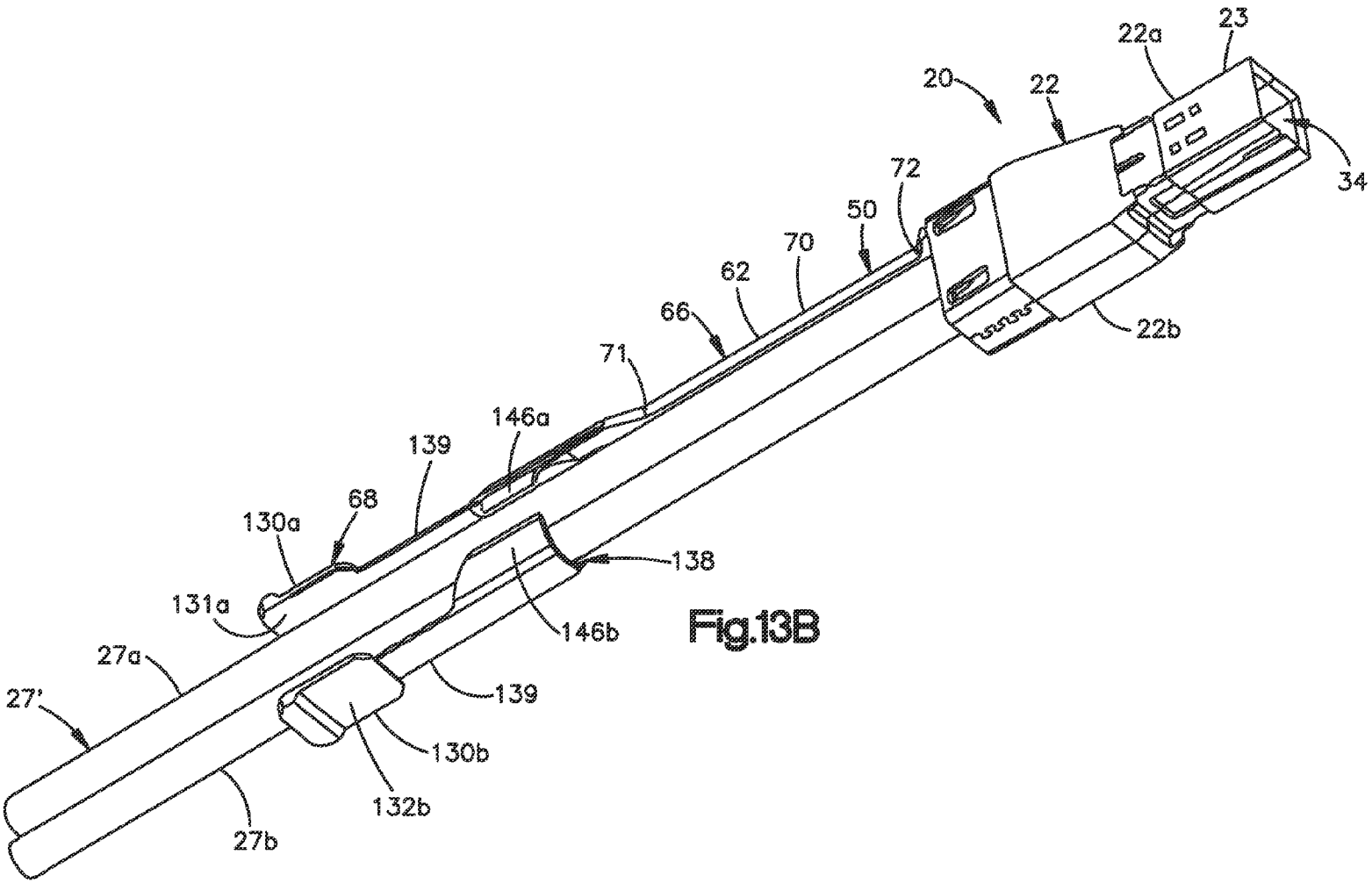
FIG. 13B is another perspective view of the electrical connector illustrated in FIG. 13A.
Figure 13C:
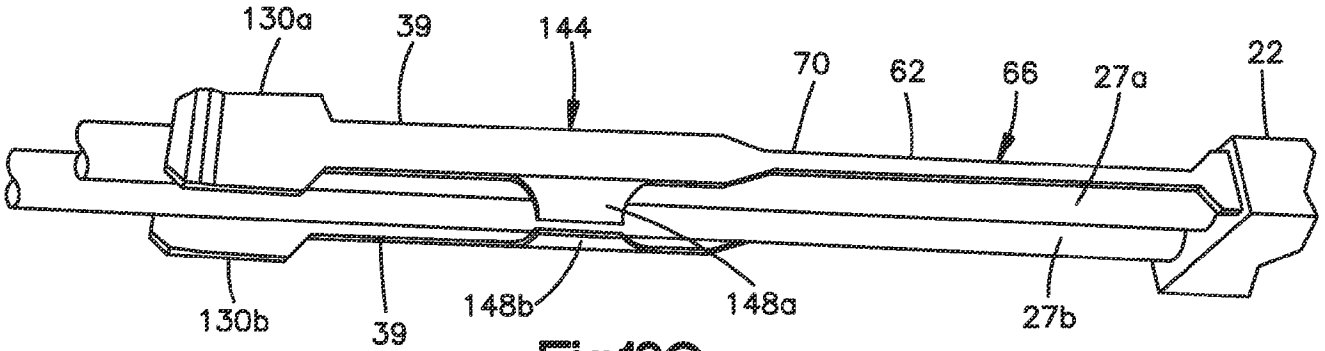
FIG. 13C is another perspective view of a grip portion of the actuator of the electrical connector illustrated in FIG. 13A.
Figure 13D:
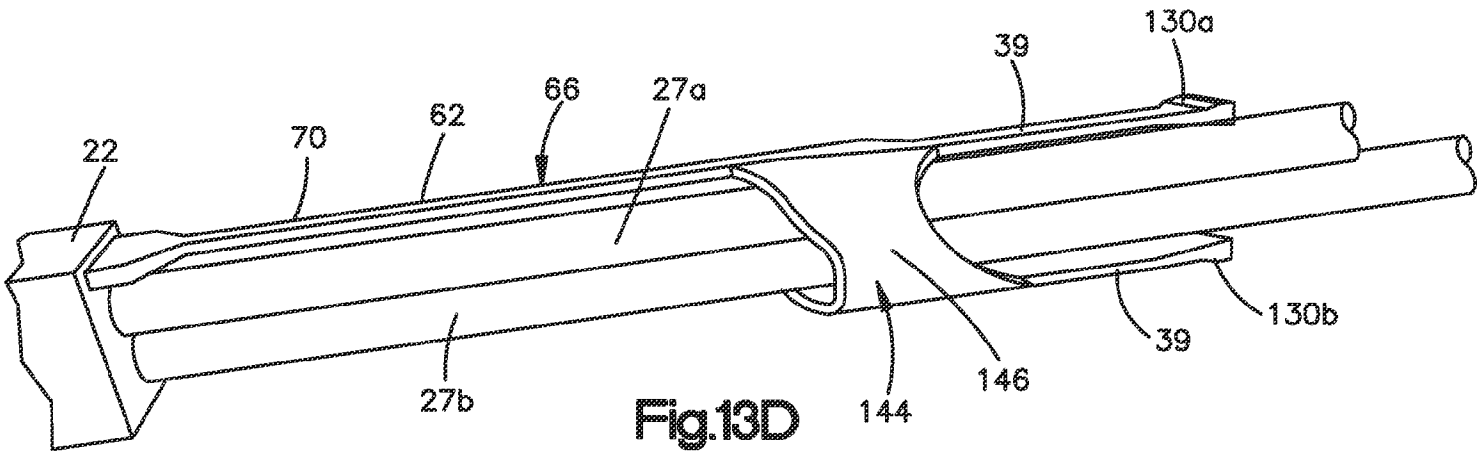
FIG. 13D is a side elevation view of the grip portion illustrated in FIG. 13C.

The mounting interface 36 can be provided as a ferrule 42 that extends rearward from the rear end 30 of the connector housing 22. The ferrule 42 is configured to receive an electrical component in the form of a cable 27 (see FIG. 5) that is operably coupled to the electrical contacts 40. The cable 27 can be a high-speed copper or fiber-optic cable that is in communication with the electrical contacts 40 at the mating interface 34. Thus, an electrical connector assembly can include the electrical connector 20 and the cable 27 that is configured to be electrically connected to the electrical connector 20, or that is electrically connected to the electrical connector 20, at the mounting interface 36. For instance, the cable 27 can be a power cable, a data transfer cable, and in one embodiment can be a fiber optic cable, such that the electrical connector is configured to mate with the complementary connector in the form of an optical transceiver. While the mounting interface 36 is illustrated in FIG. 1 as including a single ferrule 42 configured to retain a single cable, it should be appreciated that the mounting interface 36 can be configured to receive a pair of cables 27*a-b* as illustrated in FIG. 12, and to operably couple the cables 27*a-b* to select ones of the electrical contacts 40 as desired. Thus, the electrical connector 20 can be electrically connected to at least one cable at the mounting interface 36. It should be further appreciated that the mounting interface 36 can be configured to place the electrical contacts 40 in electrical communication with any suitable alternative electrical component as desired.

The mating interface 34 and the mounting interface 36 are oriented parallel to each other, such that the electrical connector 20 can be referred to as a vertical connector, though it should be appreciated that the electrical connector can be configured as desired. For instance, the electrical connector 20 can be configured as a right angle connector if desired, wherein the mating interface 34 is oriented perpendicular to the mounting interface 36.

Figure 2:
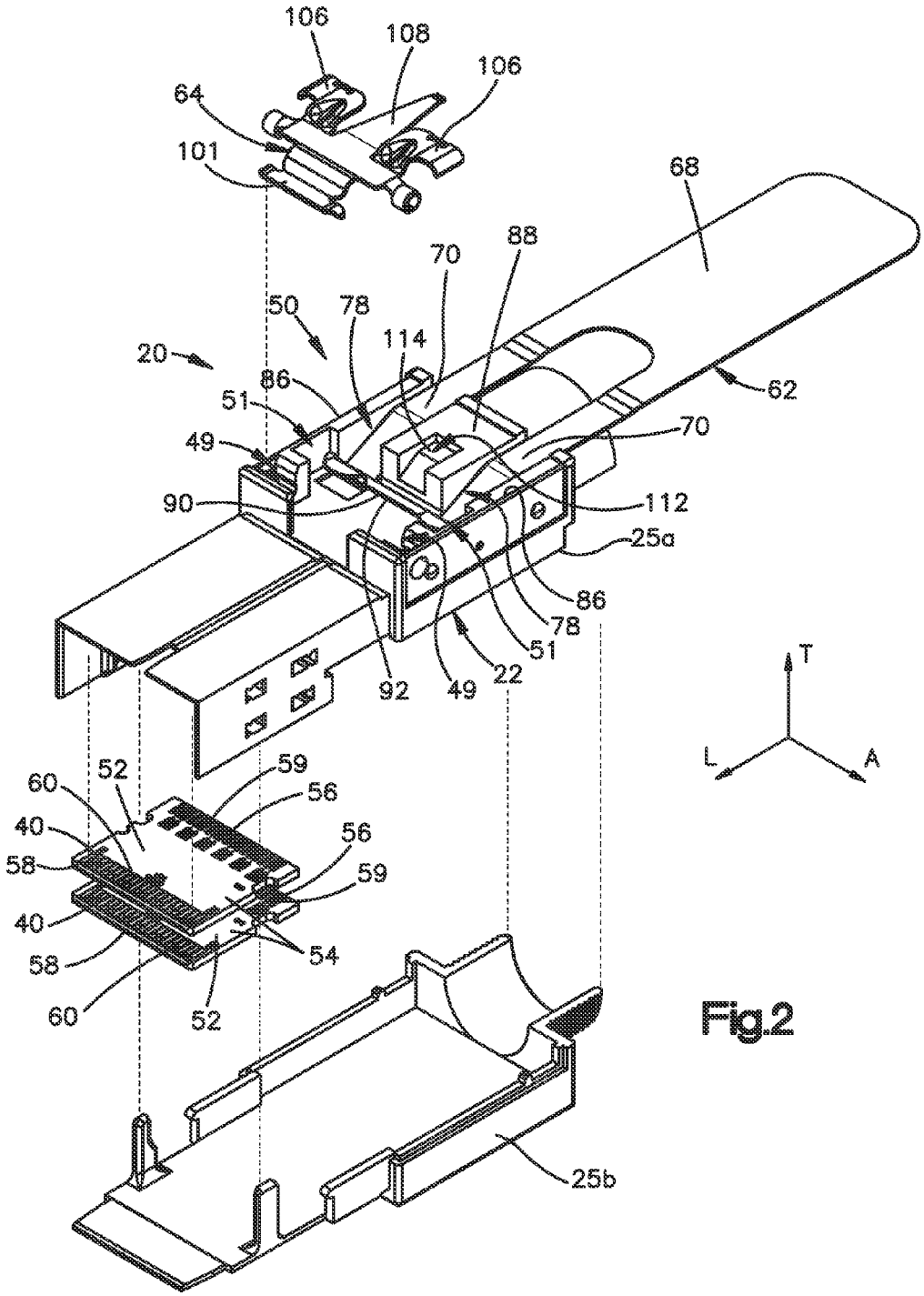
FIG. 2 is an exploded view of the electrical connector illustrate in FIG. 1, including a connector housing and a latch assembly that includes a latch and an actuator.

Referring also to FIG. 2, the connector housing 22 includes a first or upper hosing body 25*a* and a second or lower housing body 25*b* that can be joined to the upper housing body 25*a*, though it should be appreciated that the connector housing 22 can alternatively be a unitary integral structure. The electrical contacts 40 are illustrated as electrical traces that are carried by at least one substrate 52, which can be provided as a pair of printed circuit boards 54. It should be appreciated, however, that the electrical contacts 40 can be alternatively configured as desired. Each printed circuit board 54 defines a first mounting end 56 and an opposed second mating end 58. The electrical contacts 40 define a first plurality of contact pads 59 at the mounting end 56, and a second plurality of contact pads 60 at the mating end 58 that are in electrical communication with the contact pads 59 at the mounting end 56. The first plurality of contact pads 59 are configured to electrically connect to the electrical component that is connected to the electrical connector 20 at the mounting interface 36, such as the cable 27. The second plurality of contact pads 60 are configured to electrically connect to the complementary electrical connector that is connected to the electrical connector 20 at the mating interface 34. For instance, the mating end 58 can be received in a receptacle of the complementary connector housing so as to place the electrical contacts 40 in electrical communication with the complementary electrical contacts.

Figure 3:
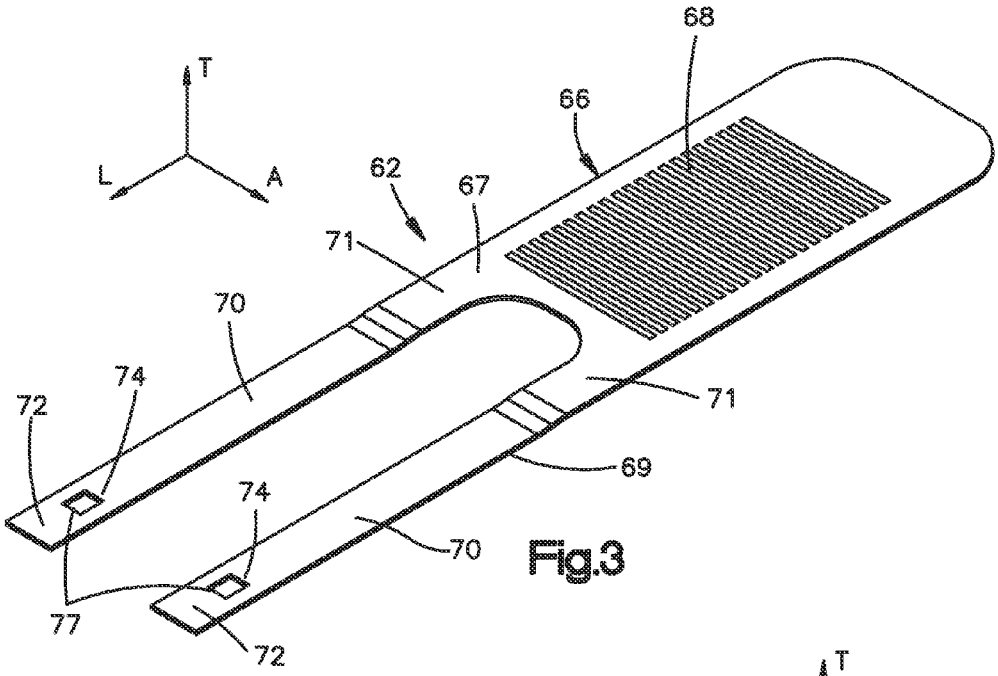
FIG. 3 is a perspective view of the actuator illustrated in FIG. 2.
Figure 6:
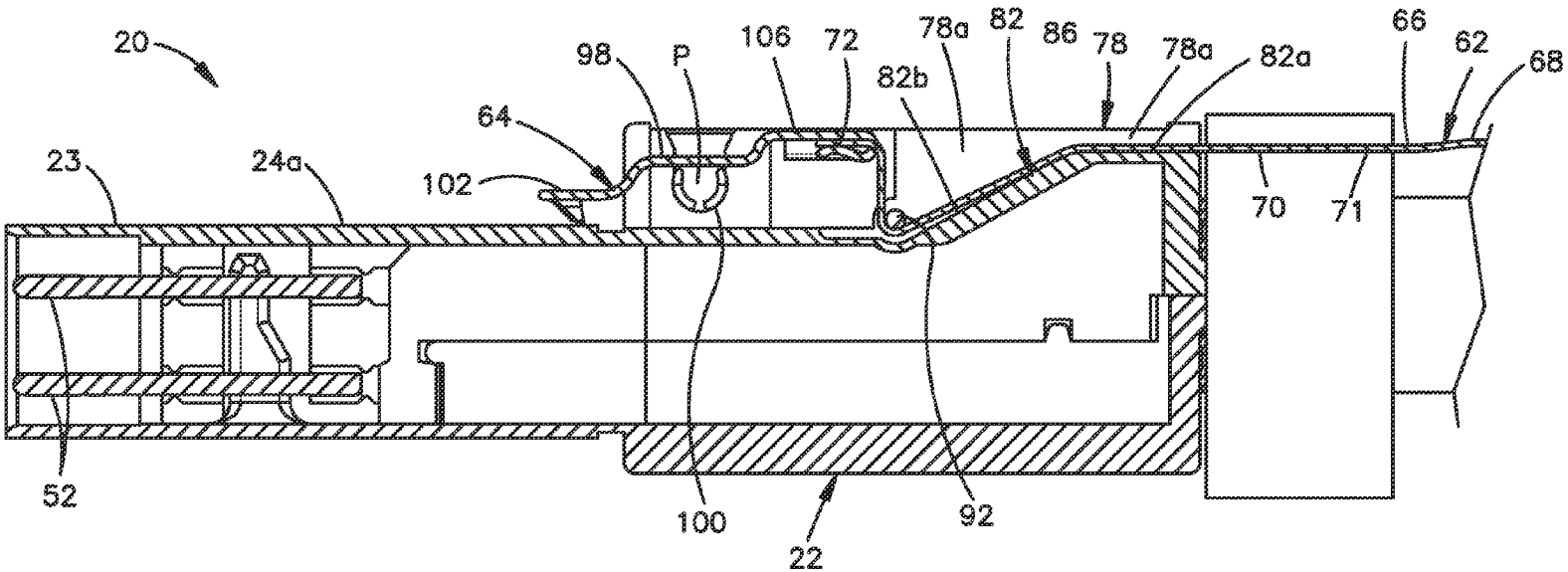
FIG. 6 is a sectional side elevation view of the electrical connector illustrated in FIG. 1, taken along line 6-6, showing the latch assembly in a latched position.

The latch assembly 50 includes an actuator 62 and a latch body 64, each of which can be made from any suitable dielectric material, such as plastic. Referring also to FIGS. 3 and 6, the actuator 62 is illustrated as a pull tab 66 that defines an upper surface 67 and an opposed lower surface 69. The pull tab 66 includes an actuator portion illustrated as a grip portion 68 that can be textured as desired, and at least one arm 70, such as a pair of laterally spaced arms 70 that extend forward from the grip portion 68. The arms 70 define respective proximal ends 71 that are connected to the grip portion 68, and opposed distal ends 72 that carry respective engagement members 74 that are configured to connect to respective complementary engagement members 76 of the latch body 64. In accordance with the illustrated embodiment, the engagement members 74 are configured as apertures 77 that extend through the arms 70. The arms 70 can be flexible as desired.

As illustrated in FIGS. 2 and 6, the connector housing 22 includes a pair of outer side rails 86, and a central body 88 spaced from the outer side rails 86 so as to define at least one recessed arm channel 78 such as a pair of recessed arm channels 78 that extend transversely down into the top end 24 of the connector housing 22 and retain at least respective portions of the arms 70 of the actuator 62. The arm channels 78 extend forward from the rear end 30, and define a proximal end 78*a* at the rear end 30, and an opposed distal end 78*b*. The arm channels 78 each define a guide surface 82 that includes an upper surface 82*a* that supports the arms 70 of the actuator 62, and a tapered ramp surface 82*b* that extends forward from the upper surface 82, and is downwardly sloped along a longitudinally forward direction from the upper surface 82*a*. The upper surface 82*a* thus defines a first surface and the ramp surface 82*b* defines a second surface that is spaced forward from the first surface and extends below, or transversely inward, the upper surface 82*a*. For instance, the ramp surface 82*b* can be tapered downward as it extends forward, and can extend straight as illustrated, or can be curved or alternatively shaped as desired.

The connector housing 22 includes a brace 90 in the form of a cross-bar 92 that extends between the outer side rails 86 at a location below, or inwardly offset along the transverse direction from, the upper surface 82*a* and forwardly spaced from the upper surface 82*a*. In accordance with the illustrated embodiment, the cross-bar 92 is disposed above the distal end of the ramp surface 82*b*, and in alignment with the ramp surface 82*b*. Thus, it can be said that the ramp surface 82*b* has a proximal end adjacent the upper surface 82*a*, the ramp surface 82*b* extending from the proximal end so as to define a distal end that is spaced below, or inwardly recessed with respect to, the proximal end. For instance, the distal end of the ramp surface 82*b* can be spaced below the brace 90. Accordingly, the pull tab 66 can be installed in the connector housing 22 such that the arms 70 are disposed in the arm channels 78, and the grip portion 68 extends rearward from the rear end 30 of the connector housing 22. The arms 70 extend forward from their proximal ends 71 along the ramp surface 82*b* and below the cross-bar 92.

Figure 4:
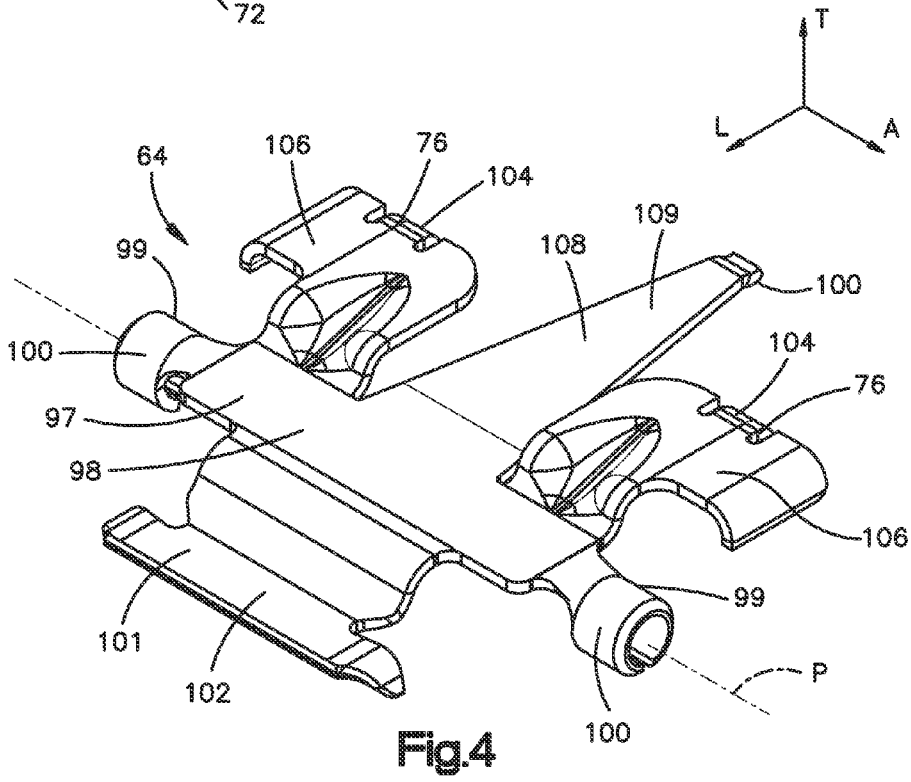
FIG. 4 is a perspective view of the latch illustrated in FIG. 2.

Referring now to FIGS. 4 and 6, the latch body 64 can be supported by the connector housing 22, and includes a main body portion 97 illustrated as a plate 98, and a pair of round (e.g., circular) pivot members 99 illustrated as dowels 100 that project laterally out from the plate 98. The connector housing 22 defines a pair of opposed notches 49 (FIG. 2) formed in the opposed side rails 86 that are configured to receive the dowels 100 such that the dowels 100 are rotatable within the notches 49. The latch body 64 defines a lateral or horizontal pivot axis P that extends laterally through the center of the dowels 100, and thus is configured to be mounted to the connector housing 22 at the pivot axis P. The latch body 64 is configured to rotate about the pivot axis P relative to the connector housing 22 as the dowels 100 rotate in the notches 49 during operation, such that the latch body 64 actuates between a latched position that secures the connector housing 22 in a mating relationship with a complementary connector housing, and an unlatched position that allows the connector housing 22 to be disconnected from the complementary connector housing. The latch body 64 further includes an engagement member 101 in the form of a latch member 102 that extends longitudinally forward and down from the plate 98. As will be appreciated from the description below, the engagement member 101 is configured to move between the latched position that is configured to retain a complementary engagement member of the complementary electrical connector so as to lock the electrical connector 20 to the complementary electrical connector when the electrical connectors are mated, and the unlatched position that removes the retention with the complementary engagement member, and allows the electrical connector 20 and the complementary electrical connector to be disconnected from each other. Thus, it can be said that the engagement member 101 is configured to releasably engage the complementary engagement member of the complementary electrical connector. For instance, as the latch body rotates about the pivot axis P from the latched position to the unlatched position, the latch member 102 moves away from the connector housing 22.

The latch body 64 further includes at least one engagement member 76, such as a pair of engagement members 76 that are configured to connect to the engagement members 74 of the pull tab 66. The engagement members 76 are disposed at a first side of the pivot axis, for instance longitudinally rearward with respect to the pivot axis P. In particular, the latch body 64 includes a pair of laterally opposed support members illustrated as wings 106 that extend behind and laterally outward from the plate 98. The connector housing 22 defines a corresponding pair of pockets 51 that extend into the side rails 86 and are sized so as to receive the laterally outer ends of the wings 106 when the latch body 64 is installed in the connector housing 22. The engagement members 76 can be provided as pegs 104 that are carried by the wings 106. Thus, the latch body 64 and the latch arms 70 of the pull tab 66 can be operatively coupled together, and connected together as illustrated, by inserting the pegs 104 into the apertures 77, as illustrated in FIG. 6. It should be appreciated that the latch body 64 and the pull tab 66 can alternatively be integrally connected or discretely connected in accordance with any suitable alternative embodiment. Furthermore, the engagement members 74 of the arms 70 can include projections and the engagement members 76 of the latch body 64 can be provided as apertures that receive the engagement members 74. The latch member 102 is disposed at a second side of the pivot axis P that is opposite the first side of the pivot axis P to which the arms 70 are attached.

Figure 5:
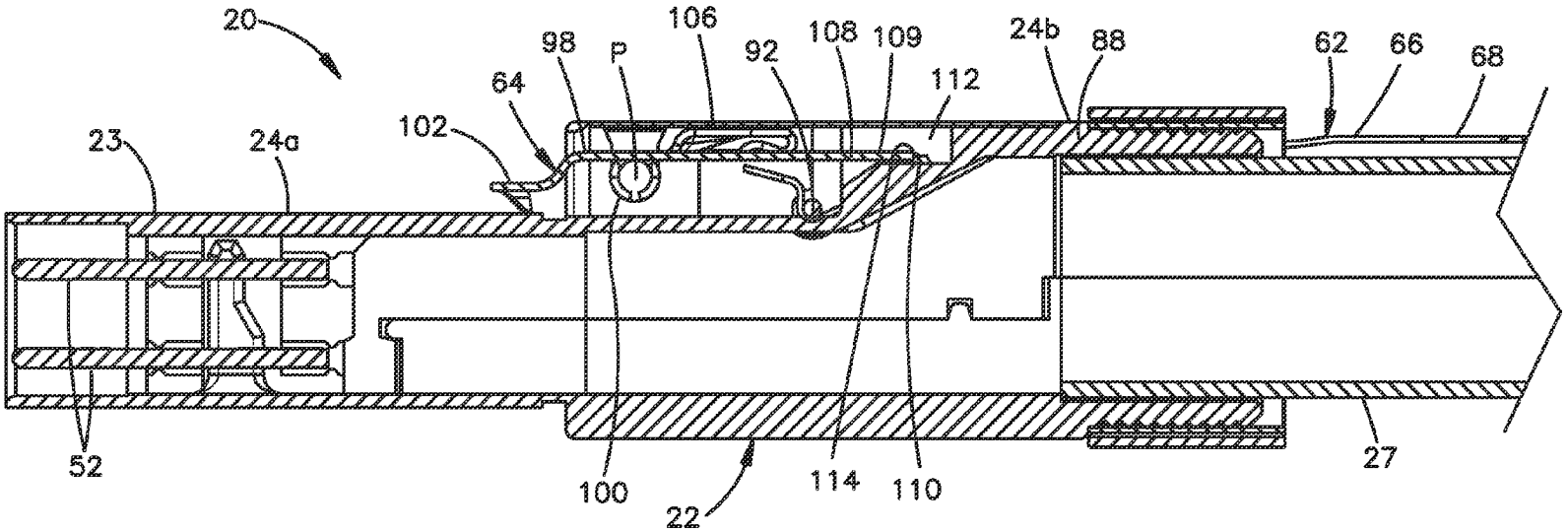
FIG. 5 is a sectional side elevation view of the electrical connector illustrated in FIG. 1, taken along line 5-5.

Referring also to FIG. 5, the latch assembly 50 further includes a spring member 108 that biases the engagement member 101 toward the latched position. In accordance with the illustrated embodiment, the spring member 108 can be integral with the latch body 64, and can define a spring plate 109 that extends longitudinally rearward from the plate 98. The spring member 108 defines a lower abutment surface 110 at its rear end, and can be flexible as desired. The connector housing 22 defines a pocket 112 that extends into the central body 88 and defines a seat surface 114 that is positioned such that the abutment surface 110 is configured to abut the seat.

Accordingly, referring to FIGS. 1-2 and 5-6, the latch body 64 can be installed in the connector housing 22 such that the laterally outer ends of the wings 106 are received in the pockets 51, and the dowels are received in the notches 49. The spring plate 100 extends over the cross-bar 92 and the abutment surface 100 is received in the pocket 112 and is configured to bear against the seat surface 114. the spring member extends proximally from the first side of the pivot location against the connector housing so as to bias the latch member against the seat surface. The seat surface 114 positions the abutment surface 110 such that the latch body 64 biases the latch member 102 toward and against the upper surface 24*a* of the shroud 23 in a latched position. In this regard, the upper surface 24 of the shroud defines a bearing surface of the connector housing 22 for the latch member 102. The pull tab 66 is installed in the connector housing 22 such that the arms 70 are disposed in the arm channels 78, and the grip portion 68 extends rearward from the rear end 30 of the connector housing 22. The arms 70 extend forward from their proximal ends 71 along the ramp surface 82*b* to a location below the cross-bar 92. The distal ends 72 of the arms 70 extend upwards and forward such that the engagement members 74 and 76, and thus the actuator 62 (e.g., pull tab 66) and the latch body 64 connect at a location above the brace 90 and behind the pivot axis P. Thus, the arms 70 define an intermediate portion that is disposed below, or inwardly recessed with respect to, the proximal ends 71 and the opposed distal ends 72 that are disposed on opposed sides of the intermediate portion. It should further be appreciated that each arm 70 includes an intermediate portion that is disposed below the interface between the arm 70 and the latch body, and is further disposed below the grip portion 68.

Figure 7:
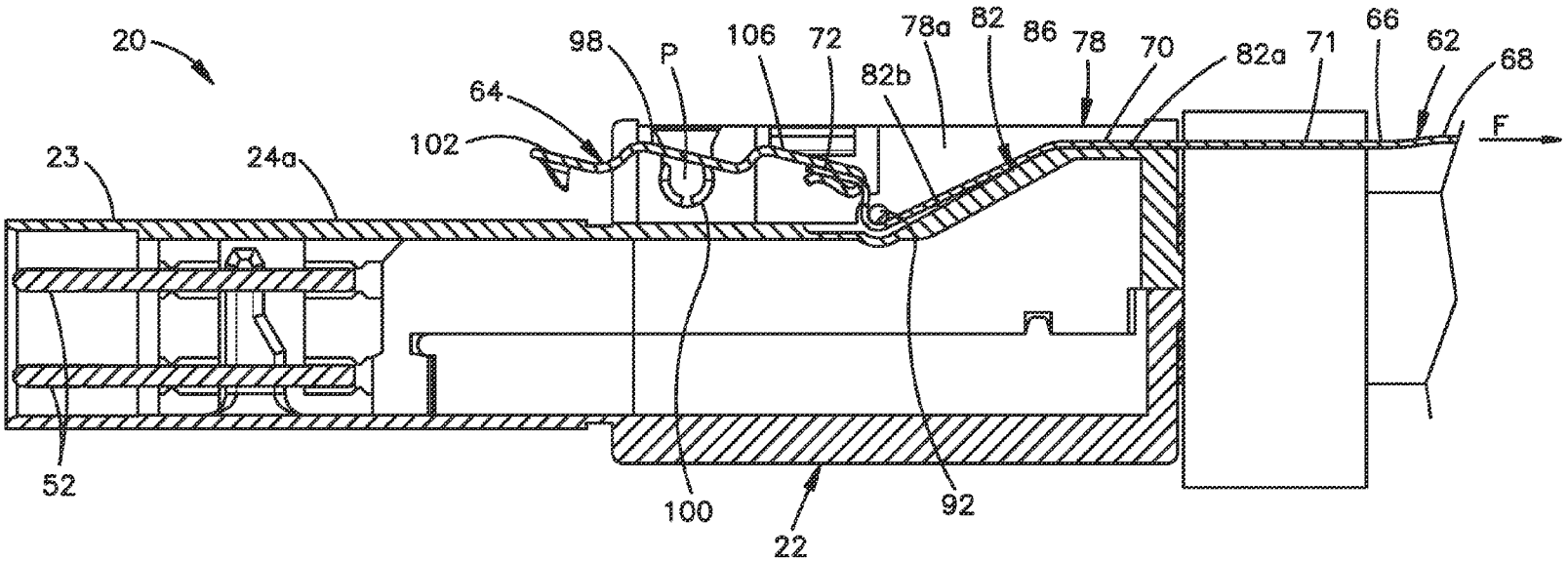
FIG. 7 is a sectional side elevation view of the electrical connector as illustrated in FIG. 6, but showing the latch assembly in an unlatched position.

Referring now to FIGS. 6 and 7, the latch assembly 50 is operable between a normal latched position and an unlatched position. In particular, the seat surface 114 is normally positioned against the abutment surface 100 such that the spring member 108 provides a spring force that biases the latch body 64 about the pivot axis P in a first direction such that the latch member 102 is urged toward and against the upper surface 24*a* of the shroud 23. Thus, when the electrical connector 20 is mated with a complementary electrical connector, a complementary engagement member of the complementary connector housing, such as a catch, can engage the engagement member 101 (e.g., latch member 102) of the electrical connector 20.

When a user applies a longitudinally rearwardly directed actuation force F (see FIG. 7) to the pull tab 66, and in particular to at least one or a pair of grip tabs 130 (see FIG. 8), along a direction away from the connector housing 22, the latch assembly 50 is actuated to an unlatched position. In particular, the distal ends 72 of the arms 70 are biased downward and slightly longitudinally rearward toward the lower surface of the brace 91 (e.g. cross-bar 92), whereby the latch body pivot about the pivot axis P in a second direction opposite the first direction against the spring force provided by the spring member 108, which increases as the abutment surfaces 110 is further biased against the seat surface 114. Movement of the latch body 64 in the second direction causes the engagement member 101 to move away from the upper surface 24*a* of the shroud 23, thereby allowing the electrical connector 20 to be removed from the complementary electrical connector.

The embodiments described in connection with the illustrated embodiments have been presented by way of illustration, and the present invention is therefore not intended to be limited to the disclosed embodiments. Furthermore, the structure and features of each the embodiments described above can be applied to the other embodiments described herein, unless otherwise indicated. For instance, while the latch body 64 and the pull tab 66 are discretely connected in accordance with the illustrated embodiment, the latch body 64 and the pull tab 66 can alternatively be integral with each other. Furthermore, while the latch body 64 is discretely attached to the connector housing 22 in accordance with the illustrated embodiment, it should be appreciated that the latch body can alternatively be integral with the connector housing 22. For instance, the pivot members 99 could be integrally connected to the connector housing 22 such that the latch body 64 can pivot about the pivot members 99 as described above. Additionally, it should be appreciated that the engagement member 101 could be configured as any suitable engagement member configured to latch the electrical connector 20 with the complementary connector when the latch assembly 50 is in the latched position. For instance, the engagement member could alternatively be provided as a catch member instead of a latch member, and can thus be configured to receive a complementary latch member of the complementary electrical connector when the latch assembly 50 is in the latched position.

It should be appreciated that the actuator 62 can be constructed in accordance with an alternative embodiment. For instance, referring now to FIG. 8, the electrical connector 20 is illustrated whereby the arm channels 78 extend into the front surface 30 and can be encapsulated by the connector housing 22 and in particular the rear housing portion 22*b*. Accordingly, at least a portion of the top, bottom, and lateral sides of the arm channels 78 can be encapsulated by the rear housing portion 22*b*. In that regard, it should be appreciated that the upper surface 82*a* of the arm channels 78 can be defined by the top end 24 of the connector housing 22, or can be transversely inwardly recessed from the top end 24 of the connector housing 22.

Figure 8:
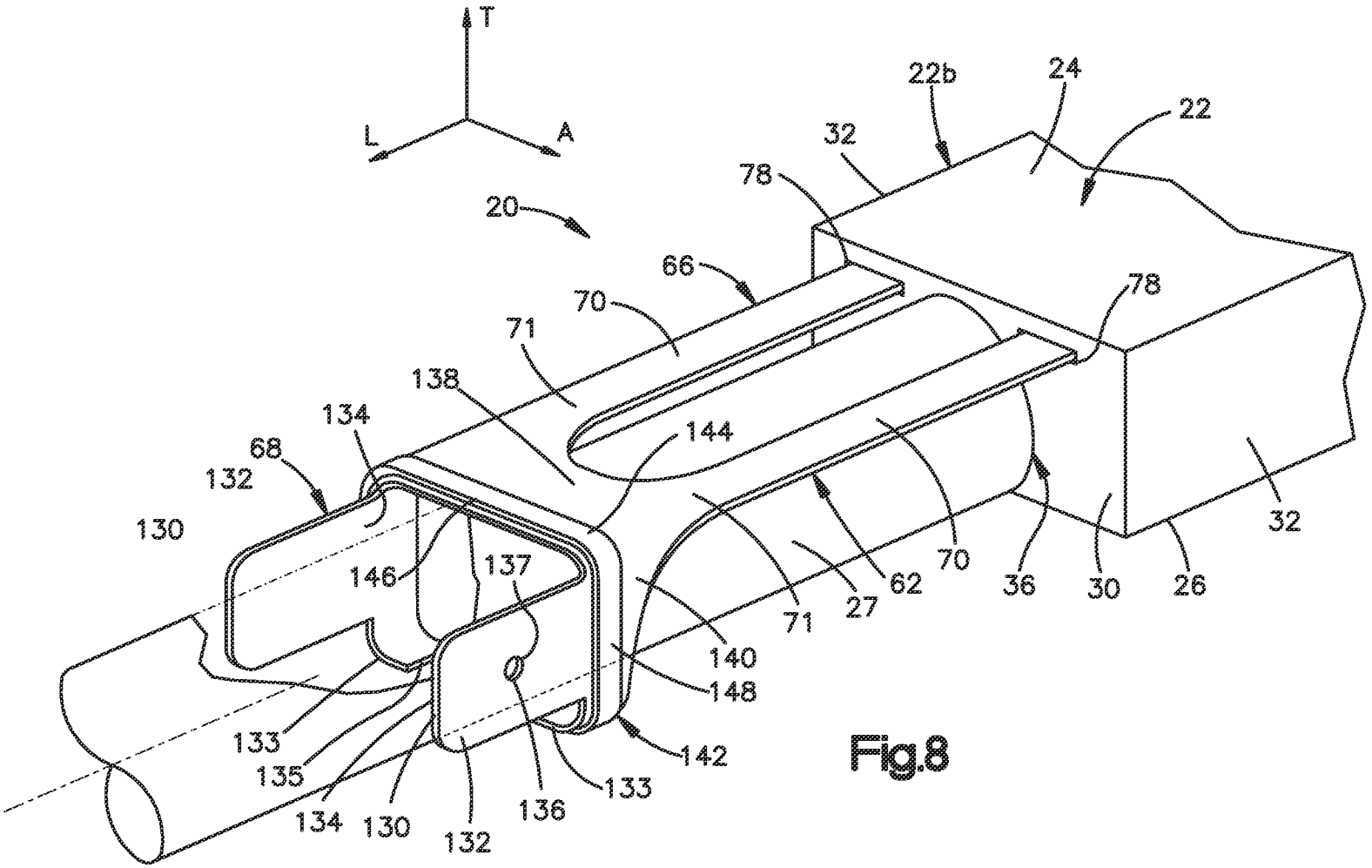
FIG. 8 is a perspective view of a portion of the electrical connector illustrated in FIG. 1 connected to a cable, but showing the electrical connector as including a pull tab constructed in accordance with an alternative embodiment, shown with a portion of the cable cute away.

Furthermore, the arms 70 can extend rearwardly out from the connector housing 22 at a position whereby the proximal ends 71 of the arms 70 are spaced from the top end 24 of the connector housing 22 a first distance, and are further spaced from the bottom end 26 of the connector housing 22 a second distance, such that the first distance is less than the second distance. Accordingly, the arms 70 are supported by the connector housing 22 at a position such that the arms 70 are configured to be disposed transversely above the mounting interface 36, and thus the ferrule 42, and thus also the cable 27, it being appreciated that the arms 70 can alternatively be supported by the connector housing 22 at a position such that the arms 70 are configured to be disposed transversely below the cable 27, such that the first distance is greater than the second distance. Alternatively still, the arms 70 can be supported by the connector housing 22 at a position such that the arms 70 are configured to be disposed laterally outward from the cable 27. Alternatively still, the arms 70 can be supported by the connector housing 22 at a position such that one arm 70 is configured to be disposed laterally above, below, or laterally outward of the cable 27, and the other arm 70 is configured to be disposed laterally above, below, or laterally outward of the cable 27. The arms 70 thus can be positioned on opposed sides of the housing, as opposed to a common side of the housing as illustrated in FIG. 8.

The grip portion 68 of the pull tab 66 includes a flexible junction 138 that is connected, for instance laterally connected as illustrated, between the proximal ends 71 of the arms 70. The grip portion 68 further includes at least one or more grip members in the form of grip tabs 130 that may be laterally spaced apart, may be laterally opposed, and can define the terminal ends of the pull tab 66. The junction 138 can further include an interface portion 140 that extends transversely down and is connected to the grip tabs 130. Thus, it can be said that the grip tabs 130 are connected or operably coupled to the arms 70, such that an actuation force applied to the grip tabs 130 is transferred to the arms 70. The grip tabs 130 can be connected to the arms 70 indirectly via the junction 138, or can alternatively be directly connected to the arms 70. For instance, the grip tabs 130 can be integrally constructed with the arms 70 or discretely connected to the arms 70 as desired.

The grip tabs 130 each define an inner surface 134, which can be a laterally inner surface in accordance with the illustrated embodiment, such that the inner surfaces 134 are spaced apart a distance at least equal to or greater than the diameter or lateral dimension of the cable 27. Accordingly, the cable 27 extends between the inner surfaces 134 of the opposed grip tabs 130. The grip tabs 130 further each define an outer surface 132 which is opposed from the inner surface 134 and can carry a textured grip 136 as desired. The pull tab 66 can further define at least one aperture 137 that extends through at least one or both of the grip tabs 130, for instance laterally through the grip tabs 130 along a direction toward the other of the grip tabs 130. The aperture 137 is configured to engage a pull tool, such as a hook tool having a hook member that can be inserted into the aperture 137. Thus, during operation, a user can manually grasp the outer surfaces 132 or another portion of the grip tabs 130, which can define a smooth surface, a textured surface, or tool receiving apertures 137, with his and her fingers or a pull tool that can include a hook that extends into the tool receiving holes, and apply a longitudinally rearward force to the pull tab 66 in the manner described above so as to selectively actuate the latch assembly 50 in the manner described above. The pull tab 66 travels along the cable 27 as it actuates the latch assembly 50 between its latched and unlatched positions. Because the grip tabs 130 are partially wrapped about the cable 27, the grip tabs 130 can be maintained in close proximity to the cable 27, such that a user is able to intuitively ascertain the grip tabs 130 that are associated with a given connector housing 22, for instance when a plurality of electrical connectors 20 are mounted onto a common panel in close proximity. The grip tabs 130 can be substantially planar, curved, or otherwise shaped as desired.

It is appreciated that the components of the pull tab 66 can be integrally fabricated from a unitary flexible material, such as a flexible plastic. The flexible material facilitates bending of the latch arms 70, for instance at their distal ends 72 (see FIG. 3) during operation. The pull tab 66 can further include a pair of curved cable grips 133 that extend down from the grip tabs 130 at a location forwardly spaced from the longitudinally rear end of the grip tabs 130. The cable grips 133 can be curved or otherwise shaped so as to generally correspond to the shape of the outer surface of the cable 27, and are spaced from each other at their distal ends, such that the actuator 62, and in particular the pull tab 66, is discontinuous about the cable 27. The cable grips 133 define respective ends 135 that are opposed, such as laterally opposed, and spaced apart a distance less than the diameter or lateral cross-section of the cable 27. The ends 135 are spaced from the junction 138 and/or arms 70 a transverse distance substantially equal to or alternatively less than or greater than the diameter or height of the cable 27. The cable grips 133 can thus partially wrap around the cable 27 but leave enough flexibility so that the cable 27 can freely move with respect to the pull tab 66 and the pull tab 66 can move freely with respect to the cable. Accordingly, the pull tab 66 is sized such that the cable 27 is received between the grip tabs 130, and between the interface 138 and the cable grips 133. The cable grips 133 can be flexible and pop onto or off of the cable 27 along a direction that is offset from the longitudinal direction L when mounting the cable 27 to the electrical connector 20, or removing the cable 27 from the electrical connector 20. For instance, the ends 135 can flex outward away from each other so as to receive the cable 27, and subsequently flex inward so as to capture the cable as illustrated in FIG. 8. and can further be slidable in the ends 135, and thus in the cable grips 133. Alternatively, the cable 27 can be inserted longitudinally forward between the grip tabs 130 and mounted to the electrical connector 20.

The pull tab 66 can further include a rigid reinforcing member 142 that has a stiffness or rigidity greater than that of at least one or all of the proximal ends 71 of the latch arms 70, the junction 138, the interface 140, and the grip tabs 130. The reinforcing member 142 can be provided as a discontinuous reinforcing band 144 that extends about the junction 138, for instance about the outer surface of the junction 138. For instance, the reinforcing band 144 can have a stiffness that is greater than that of the junction 138, and can include a laterally elongate upper portion 146 that is attached to the outer surface of the junction 138, and opposed arms 148 of that extend down from the laterally opposed ends of the upper portion 146. The arms 148 can be curved or otherwise shaped so as to at least generally correspond to the curved outer surface of the cable 27. The arms 148 can wrap around a portion of the cable 27 so as to define opposed ends that are carried by the cable grips 133 and are spaced apart, such that the reinforcing band 144 is discontinuous. The reinforcing band 144 can extend along the outer surface of the junction 138 and the interface 140, and add rigidity to the cable grips 133 and bias the cable grips 133 toward their inwardly flexed position after the grips 133 are flexed outward so as to receive the cable 27. While the reinforcing member 142 is illustrated as a reinforcing band 144 that is discretely attached (e.g., adhesively) to the pull tab 66, the reinforcing member 142 can alternatively be integral with the pull tab 66. For instance, the reinforcing member 142 can be a region of increase thickness on the pull tab 66. The reinforcing band 144 can be made from any material as desired, such as a plastic, which can be a flexible plastic, or a metal.

Figure 9:
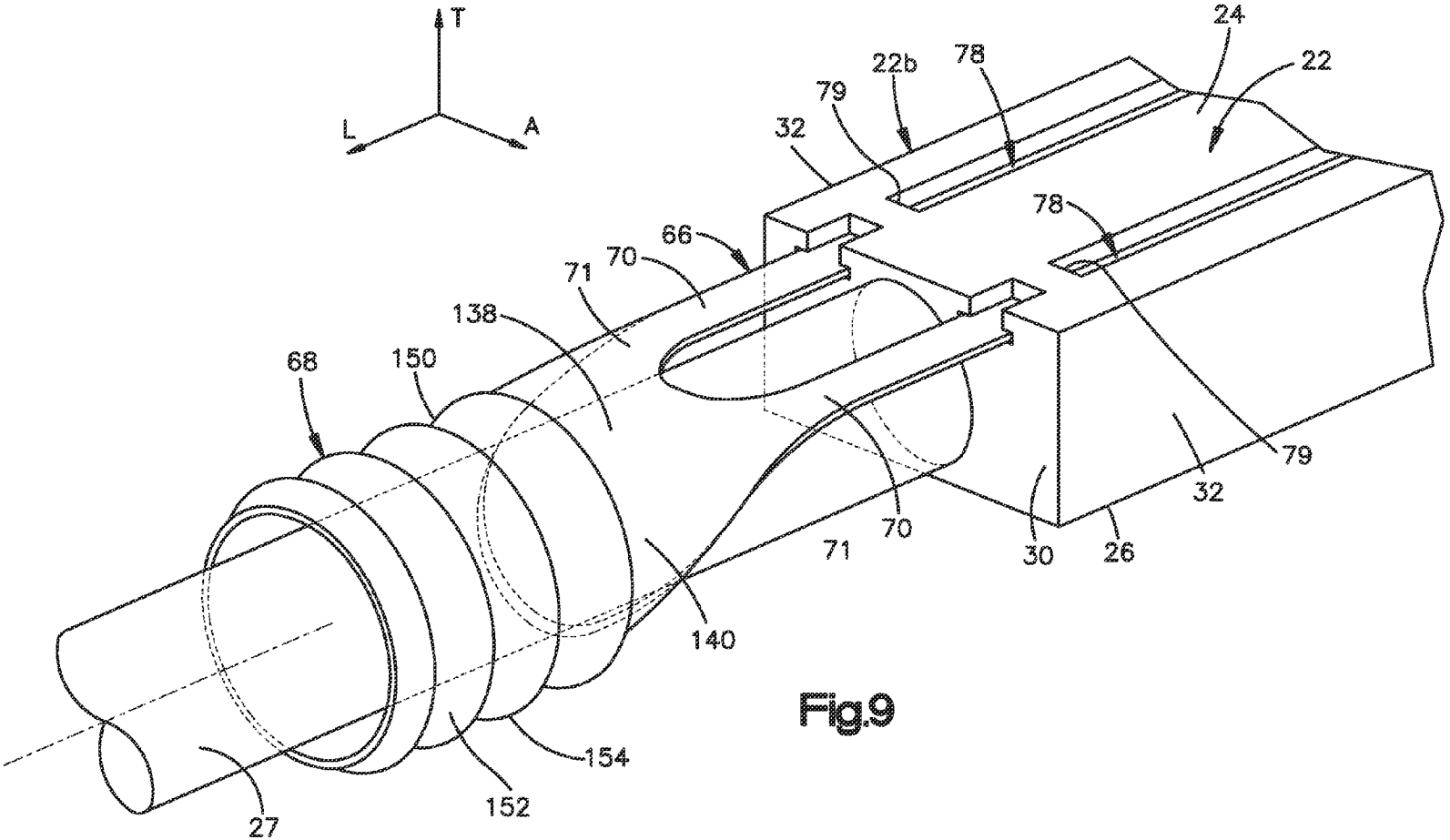
FIG. 9 is a perspective view of the electrical connector illustrated in FIG. 8, wherein the pull tab is constructed in accordance with another embodiment.

Referring now to FIG. 9, the electrical connector 20 can include at least one retention beam 79 that extends laterally over the channel 78 so as to retain the latch arms 70 in the rear housing portion **22*b*. The grip portion 68 of the pull tab 66 can include a substantially tubular body 150 that is sized to surround the cable 27. It should be appreciated that the tubular body 150 can be substantially cylindrical as illustrated, or can define any suitable alternative shape as desired. The tubular body 150 can be integrally or discretely connected to the junction 138 and the interface 140, and thus integrally or discretely connected to the latch arms 70. The tubular body 150 defines an outer grip surface 152 that can have a textured region 154 to facilitate the application of an actuation force by a user in the manner described above. The tubular body 150 can also have a stiffness or rigidity that is substantially equal to, greater than, or less than, that of the other components of the pull tab 66. Furthermore, while the tubular body 150 is illustrated as surround the cable, it should be appreciated that a gap can extend longitudinally through the tubular body 150** such that the tubular body is circumferentially discontinuous.

In both embodiments, it should be appreciated that the tubular body 150 can be said to be substantially continuous.

Figure 10A:
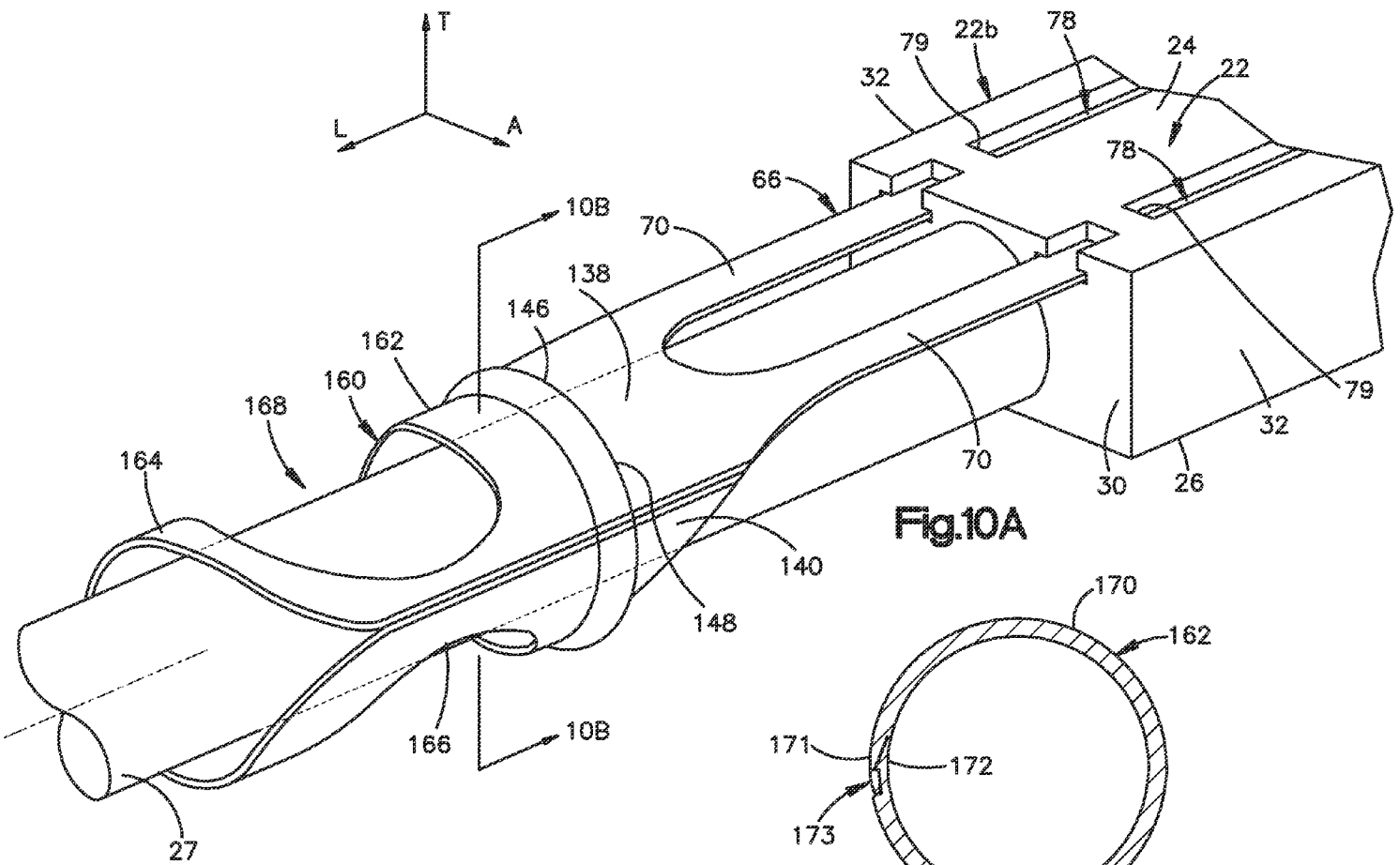
FIG. 10A is a perspective view of the electrical connector illustrated in FIG. 9, but including a pull tab constructed in accordance with another embodiment.
Figure 10B:
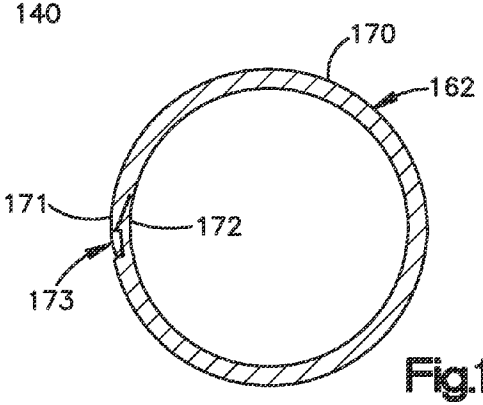
FIG. 10B is a sectional end elevation view of the pull tab illustrated in FIG. 10A, taken along line 10B-10B and shown with the cable removed.

Referring now to FIGS. 10A-B, the grip portion 68 of the pull tab 66 can include a tubular body 160 that includes a pair of longitudinally spaced grip members that are spaced along the length of the cable 27. The grip members can be substantially continuous, and can include a longitudinally forward ring 162 that is circumferentially continuous at a consistent longitudinal position such that the circumferential path can define the shape of a circle, and a longitudinally rear wrap portion 164 that is circumferentially continuous at different longitudinal locations, such that the circumferential path does not define the shape of a circle. The tubular body 160 further includes an interface 166 that is longitudinally connected between the forward ring 162 and the rear wrap portion 164. Part of all of the tubular body 160, such as the forward ring 162, can be formed from any material as desired, such as a stiff plastic. The tubular body 160 can define a cutout 168 that is disposed longitudinally between a portion of the forward ring 162 and a portion of the rear wrap portion 164.

The forward ring 162 can include a ring body 170 that defines a pair of opposed circumferential ends 171 and 172 that engage at an interlocked interface 173. For instance, one of the circumferential ends 171 and 172 can define a latch and the other circumferential end can define a catch. Otherwise stated, the circumferential ends 171 and 172 define respective detents that interlock so as to circumferentially close the ring body 170. A circumferential separation force applied to the ends 171 and 172 releases the interlocked interface 173. When the interface 173 is disengaged, the ring body 170 can be flexed outward so as to receive the cable 27 between the ends 171 and 172 along a direction that is angularly offset with respect to the longitudinal direction L. When the interface 173 is engaged, the cable 27 is releasably locked in the forward ring 162. The interface 173 can be subsequently disengaged such that the ring body 170 can be flexed outward such that the cable can be removed from the ring along a direction that is angularly offset with respect to the longitudinal direction L. Alternatively, the cable 27 can be inserted and removed from the electrical connector 20 along the longitudinally direction L through the forward ring 162.

It should be appreciated that the rear wrap portion 164 can also include an interlock 173 as illustrated and described with respect to the forward ring 162, and can thus operate in the manner described above with respect to the forward ring 162 to facilitate insertion and removal of the cable 27.

The pull tab 66 can also include a flexible hinge 176 that can be formed in or otherwise carried by the ring body 170. For instance, the flexible hinge 176 can be provided as a longitudinally extending necked down region of reduced thickness with respect to the circumferentially surrounding region of the pull tab 66. Alternatively, the flexible hinge 176 can be provided as a discrete hinge member that is discretely connected to the pull tab 66. The flexible hinge 176 can extend longitudinally through the interface 140, the forward ring 162, the interface 166, and the wrap portion 164 so as to facilitate the opening and closing of the forward ring 162 and the wrap portion 164 in the manner described above.

Figures 11A, 11B:
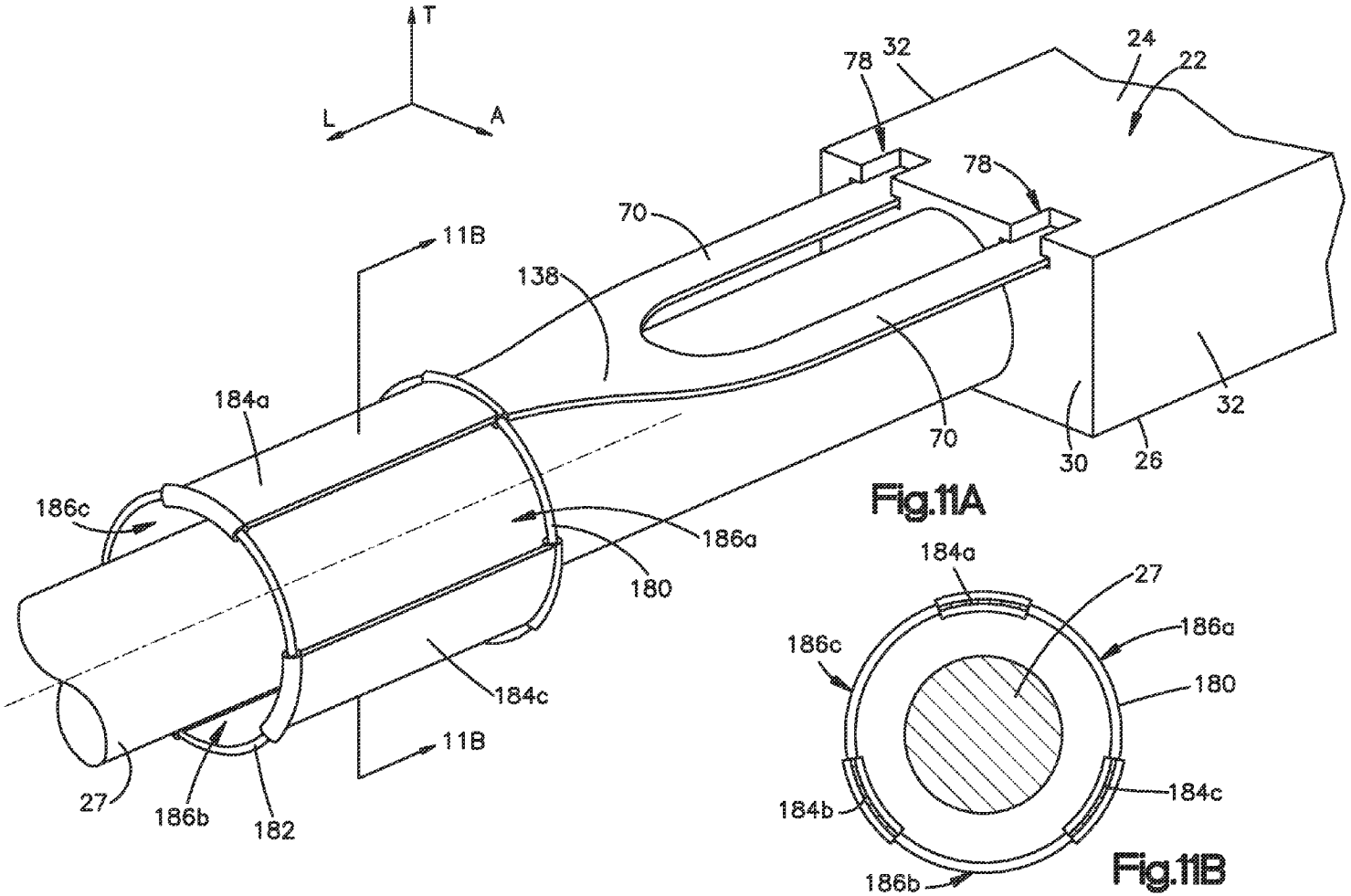
FIG. 11A is a perspective view of the electrical connector illustrated in FIG. 10A, but including a pull tab constructed in accordance with another embodiment.
FIG. 11B is a sectional end elevation view of the pull tab illustrated in FIG. 11A, taken along line 11B-11B.

Referring now to FIGS. 11A-B, the grip portion 68 includes a pair of grip members that are longitudinally spaced apart along the length of the cable 27, and can be configured as rings, such as a first longitudinally forward ring 180 and a second longitudinally rearward ring 182. The forward ring 180 is attached to the longitudinally rear end of the junction 138, and the rearward ring 182 is longitudinally rearwardly spaced from the forward ring 180. The forward and rearward rings 180 and 182 are configured to surround the cable 27, and can be made from any material as desired, such as plastic or metal. Thus, the forward and rearward portions 180 and 182 can be more rigid or stiff than the surrounding regions of the grip portion 68.

The grip portion 68 further includes at least one connecting member such as a plurality of connecting members illustrated as panels 184*a-c* that are connected between the forward and rearward rings 180 and 182 at their longitudinally forward and rearward ends. At least a select two of the panels 184*a-c* that form an adjacent pair of the panels 184*a-c* are circumferentially spaced from each other. As illustrated, all of the panels 184*a-c* are circumferentially spaced from each other so as to define corresponding air pockets 186*a-c* disposed between adjacent panels 184*a-c*. A select one of the panels 184*a* can be aligned and continuous with the junction 138, or can be discretely connected to the junction 138 via the forward ring 180. The panels 184*a-c* can be flexible or semiflexible, or otherwise can have a stiffness or rigidity less than that of the forward and rearward rings 180 and 182. The panels 184*a-c* define respective outer surfaces 188*a-c* and the forward and rearward rings 180 and 182 can present outer grip surfaces that can be engaged by a user to apply the actuation force to the pull tab 66.

It should be appreciated that the panels 184*a-c*, and thus the pockets 186*a-c*, can be circumferentially spaced equidistantly or variably. Furthermore, the panels 194*a-c* and thus the pockets 186*a-c* can define the same or different circumferential lengths with respect to the other panels or pockets. In accordance with the illustrated embodiment, three panels 184*a-c* are circumferentially equidistantly spaced 120° apart, and three pockets 186*a-c* are circumferentially equidistantly spaced 120° apart. The grip portion 68 can include any number of panels 184*a-c* and pockets 186*a-c* as desired. In accordance with the illustrated embodiment, the panels 184*a-c* define a circumferential distance that is greater than that of the interposed pockets 186*a-c*.

Referring to FIGS. 12-13D and 15A-B, the mounting interface 36 of the electrical connector can be configured to receive a cable assembly 27' that can include at least one cable such as a pair of cables 27*a-b*. The mounting interface 36 can include a corresponding pair of ferrules 42 of the type illustrated in FIG. 1 so as to support the corresponding pair of cables 27*a-b*. The ferules 42 can be in a side-by-side orientation spaced along the traverse direction T as illustrated, or spaced along the lateral direction or any suitable alternative direction as desired, such that the centers of the cables 27*a-b* are spaced along an axis 73. In accordance with the illustrated embodiment, the axis 73 extends along the transverse direction T, though it should be appreciated that the axis 73 can extend in any direction as desired, such as the lateral direction A or any direction angularly offset with respect to the transverse direction T and the lateral direction A.

Figure 14A:
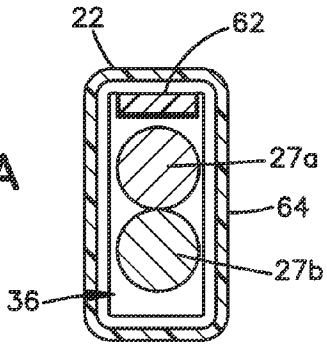
FIG. 14A is a sectional side elevation view of the electrical connector illustrated in FIG. 12, taken along line 14A-14A.
Figure 14B:
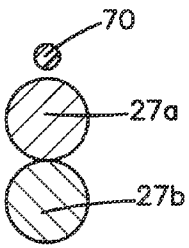
FIG. 14B is a sectional side elevation view of the electrical connector illustrated in FIG. 12, taken along line 14B-14B.
Figure 14C:
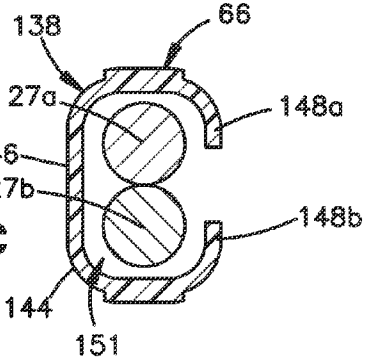
FIG. 14C is a sectional side elevation view of the electrical connector illustrated in FIG. 12, taken along line 14C-14C.
Figure 18A:
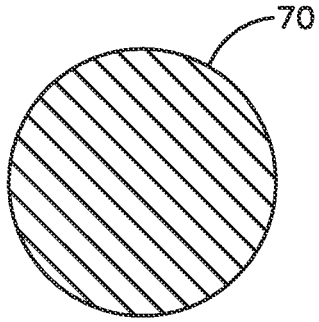
FIG. 18A is a sectional end elevation view of an arm of the electrical connector illustrated in FIG. 12, taken along line 18A-18A.
Figure 18B:
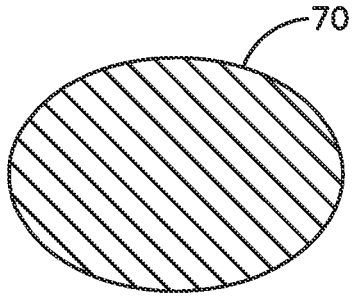
FIG. 18B is a sectional end elevation view of the arm as illustrated in FIG. 18A, but constructed in accordance with an alternative embodiment.
Figure 18C:
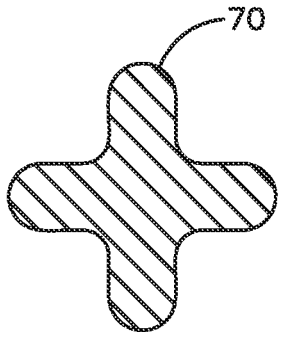
FIG. 18C is a sectional end elevation view of the arm as illustrated in FIG. 18B, but constructed in accordance with another alternative embodiment.
Figure 18D:
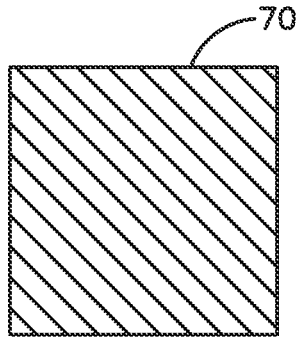
FIG. 18D is a sectional end elevation view of the arm as illustrated in FIG. 18A, but constructed in accordance with an alternative embodiment.

In accordance with the illustrated embodiment, the cable assembly 27 includes a first cable 27*a* and a second cable 27*b* that are vertically stacked, or disposed adjacent each other along the transverse direction T, such that the first cable 27*a* defines an upper cable and the second cable 27*b* defines a lower cable. Referring also to FIGS. 14A-C, the actuator 62 is illustrated as a pull tab 66 that includes an actuator portion illustrated as a grip portion 68 that can be textured as desired, and at least one arm 70 that extends forward from the grip portion 68 and can define any suitably shaped cross-section, including a round cross-section, such as a substantially circular cross-section (FIG. 18A), a substantially oval cross-section (FIG. 18B), a substantially plus-shaped cross-section (FIG. 18C), or a substantially rectangular cross-section including a square cross-section (FIG. 18D), or any suitable alternative cross section.

Alternatively, the arm 70 can be substantially planar in a horizontal plane defined by the longitudinal L and lateral A directions. The arm 70 extends longitudinally along the upper end of the upper cable 27*a*, though the arm 70 could alternatively extend along the lower end of the lower cable 27*b*, or between the cables 27*a* and 27*b*. Alternatively still, the arm 70 extends laterally outward of one or both of the cables 27*a* and 27*b*. The arm 70 defines a proximal end 71 that is connected to the grip portion 68, and an opposed distal end 72 is connected, for instance discreetly or integrally, to the latch body 64. The arm 70 can be flexible as desired. Alternatively, the pull tab 66 can include a plurality of arms 70, such as a pair of arms 70, that can extend above the upper cable 27*a*, between the cables 27*a* and 27*b*, below the lower cable 27*b*, and/or laterally outward of one or both of the cables 27*a* and 27*b* as desired. A select one of the arms 70 can be forked at its distal end so as to attach to the latch body 64 in the manner described above with respect to FIGS. 1-7. Alternatively or additionally, both of the arms 70 can be forked so as to attached to respective latch bodies 64, for instance if latch bodies are attached to the opposite sides of the connector housing 22 so as to bias the respective latch members 102 against opposite sides of the shroud 23.

The grip portion 68 of the pull tab 66 includes at least one grip tab, such as a first grip tab 130*a* and a second grip tab 130*b* that is spaced from the first grip tab 130*a*, such that the at least one cable 27, or the cables 27*a* and 27*b*, are disposed between the grip tabs 130*a* and 130*b*. In accordance with the illustrated embodiment, the grip tabs 130*a* and 130*b* are spaced in the transverse direction T along a direction substantially parallel to the axis 73, such that first and second grip tabs 130*a-b* define a cable assembly-receiving gap that is sized to receive the cable assembly. The first and second grip tabs 130*a-b* can be opposed and substantially parallel to each other such that the cable assembly-receiving gap extends between the grip tabs 130*a-b*. Thus, when the electrical connector 20 is mounted to the cable assembly, the grip tabs 130*a-b* are disposed on opposed sides of the cable assembly. For instance, the first grip tab 130*a* is disposed outward from, or above, the upper cable 27*a*, and the second grip tab 130*b* is disposed outward from, or below, the lower cable 27*b*. Alternatively, the first and second grip tabs 130*a-b* can be angularly offset, and can for instance extend perpendicular to each other. In both embodiments, the inner surfaces of the first and second grip tabs 130*a-b* define the cable assembly-receiving gap and face the cable assembly to which the electrical connector 20 is mounted.

In accordance with the illustrated embodiment, the first grip tab 130*a* can be aligned with the arm 70, and can extend longitudinally rearward or proximal from the arm 70. The grip portion 68 can alternatively or additionally include an intermediate grip tab that extends between the cables 27*a* and 27*b*. In accordance with the illustrated embodiment, the grip tabs 130*a* and 130*b* are substantially planar. For instance, the grip tabs 130*a* and 130*b* are elongate in the horizontal plane as defined by the longitudinal L and lateral A directions. Alternatively, the grip tabs 130*a* and 130*b* can be curved, for instance about a longitudinally extending axis so as to generally follow the contour of the respective cables 27*a* and 27*b*. The grip tabs 130*a* and 130*b* can have a transverse thickness and a lateral width that is greater than the respective transverse thickness and lateral width of the arm 70. Accordingly, the grip tabs 130*a* and 130*b* can be more stiff, or less flexible, than the at least one arm 70.

The grip tabs 130*a* and 130*b* each define a respective inner surface 131*a* and 131*b* and an opposed outer surface 132*a* and 132*b*. In accordance with the illustrated embodiment, the inner surfaces 131*a* and 131*b* face each other, for instance along the axis 73, and are spaced apart a sufficient distance such that the cables 27*a* and 27*b* are disposed between the grip tabs 130*a-b*, for instance between the inner surfaces 131*a* and 131*b* when the grip tabs 130*a* and 130*b* are opposite each other. The outer surfaces 132*a* and 132*b* face away from the corresponding inner surfaces 131*a* and 131*b*. As described above, when the electrical connector 20 is mounted to the cable assembly, the grip tabs 130*a-b* can be substantially parallel to each other, and disposed on opposed sides of the cable assembly-receiving gap. For instance, the first grip tab 130*a* can be disposed outward from, or above, the upper cable 27*a*, and the second grip tab 130*b* can be disposed outward from, or below, the lower cable 27*b*. Alternatively, the first and second grip tabs 130*a-b* can be angularly offset, and can for instance extend perpendicular to each other. In both embodiments, the inner surfaces 131*a-b* of the first and second grip tabs 130*a-b*, respectively, define the cable assembly-receiving gap and face the cable assembly that is disposed in the cable assembly-receiving gap to which the electrical connector 20 is mounted.

The grip tabs 130*a* and 130*b* can each carry a textured gripping surface 136 at one or more up to all of the inner surfaces 131*a* and 131*b* and the outer surfaces 132*a* and 132*b* as desired. Thus, during operation, a user can manually grasp one or both of the grip tabs 130*a* and 130*b* with his and her fingers and apply a longitudinally rearward force to the pull tab 66 that causes the pull tab 66 to travel along the cable assembly 27 so as to selectively actuate the latch assembly 50 between the latched and unlatched positions.

The grip portion 68 can further include a flexible junction 138 that joins the grip tabs 130*a* and 130*b* to each other, and can also join at least one or both of the grip tabs 130*a-b* to the arms 70. The junction 138 can be provided as a discontinuous connection band 144 that includes a middle portion 146 connected between the grip tabs 130*a* and 130*b*. Thus, the junction 138 can connect the first grip tab 130*a* to the second grip tab 130*b*, such that the second grip tab 130*b*, along with the first grip tab 130*a*, is supported by the at least one arm 70. In accordance with the illustrated embodiment, the middle portion 146 can be vertically elongate and can extend along one lateral side of the cable assembly 27 in accordance with the illustrated embodiment. The connection band 144 further includes transversely opposed first and second cable retention cable grips 148*a* and 148*b* that extend transversely inward from the opposed transverse ends of the connection band 144 and slidably retain the cable assembly 27', such as the first and second cables 27*a-b*, such that the first and second cables 27*a-b* are slidable in the connection band 144, and thus in the junction 138. It should be appreciated that the tabs 130*a* and 130*b* can define a portion of the connection band 144, or the connection band 144 can define a region 145 of increased thickness along the grip tabs 130*a* and 130*b*. The middle portion 146 and the cable grips 148*a* and 148*b* can extend substantially straight or can be curved as desired.

The cable retention first cable grip 148*a* can extend down from the upper tab 130*a*, and thus defines an upper leg, and the second cable grip 148*b* can extend up from the lower tab 130*b*, and thus defines a lower leg that are spaced along the axis 73. The first and second cable grips 148*a* and 148*b* can thus extend toward each other, but terminate prior to reaching each other such that the connection band 144 defines a gap 149 disposed between the first and second cable grips 148*a* and 148*b*. Accordingly, the connection band 144 can be referred to as a discontinuous. The cable grips 148*a* and 148*b* can terminate laterally of the cable assembly 27, and on the opposed lateral side of the cable assembly 27 with respect to the middle portion 146. In accordance with the illustrated embodiment, the first cable grip 148*a* can be curved around the upper cable 27*a*, and the second cable grip 148*b* can be curved around the lower cable 27*b*. Accordingly, the cable assembly 27 can be retained in a void 151 defined by the middle portion 146 and the first and second cable grips 148*a* and 148*b*. The gap 149 can be sized less than the or greater than diameter or alternative cross-section of either or both of the cables 27*a* and 27*b*, such that the cables 27*a* and 27*b* are retained in the void 151 and slidable within the void 151. The cable grips 148*a* and 148*b* can be flexible such that a force can be applied to one or both of the cable grips 148*a* and 148*b* and/or one or both of the cables 27*a* and 27*b* sufficient to displace one or both of the cable grips 148*a* and 148*b* in order to remove one or both of the cables 27*a* and 27*b* from the void 151 as desired.

Figures 16A, 16B:
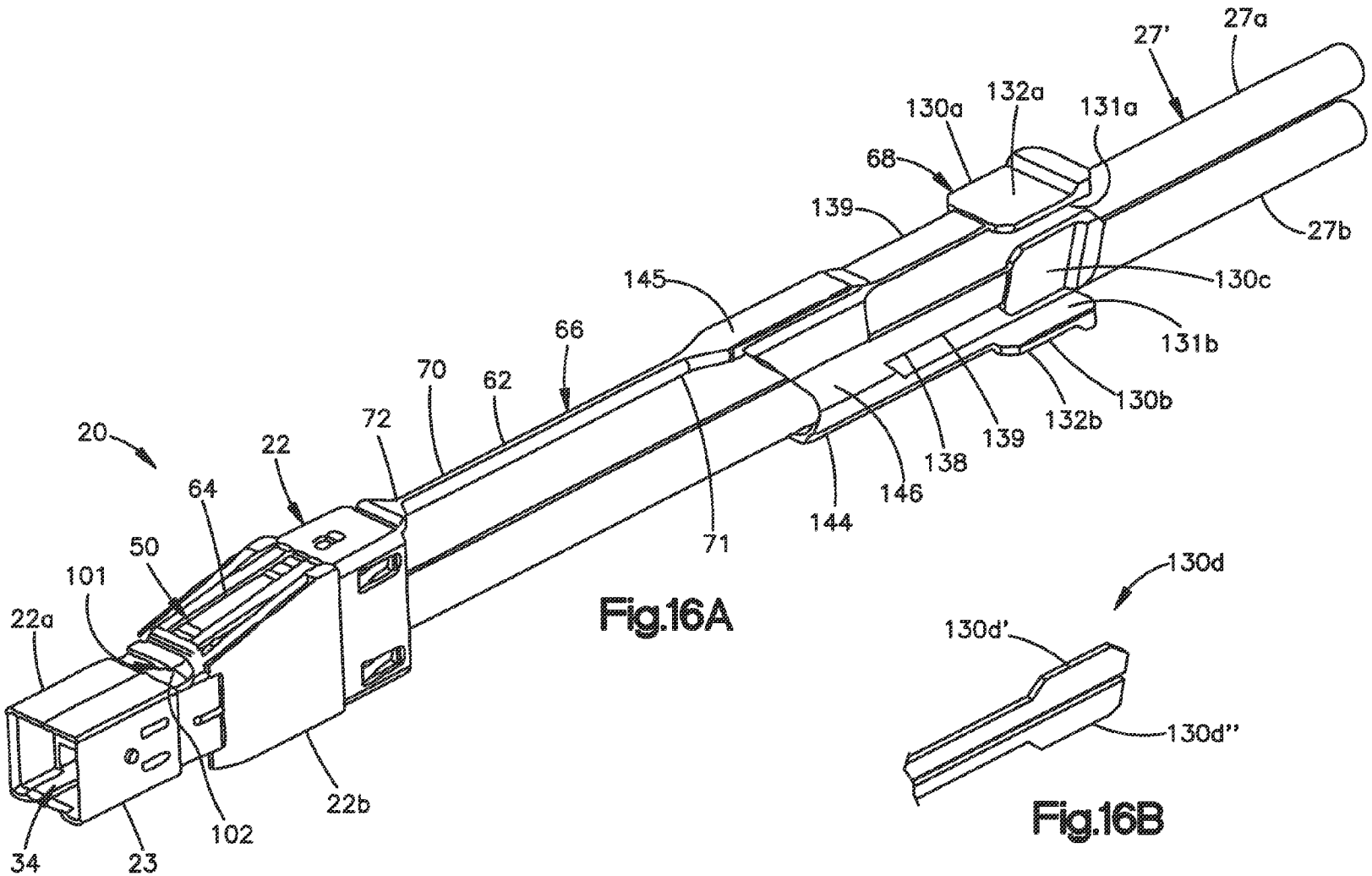
FIG. 16A is a perspective view of an electrical connector similar to the electrical connector illustrated in FIG. 13A, but including a grip portion constructed in accordance with an alternative embodiment.
FIG. 16B is a schematic view of a grip tab of the electrical connector illustrated in FIG. 16A constructed in accordance with an alternative embodiment.
Figure 17:
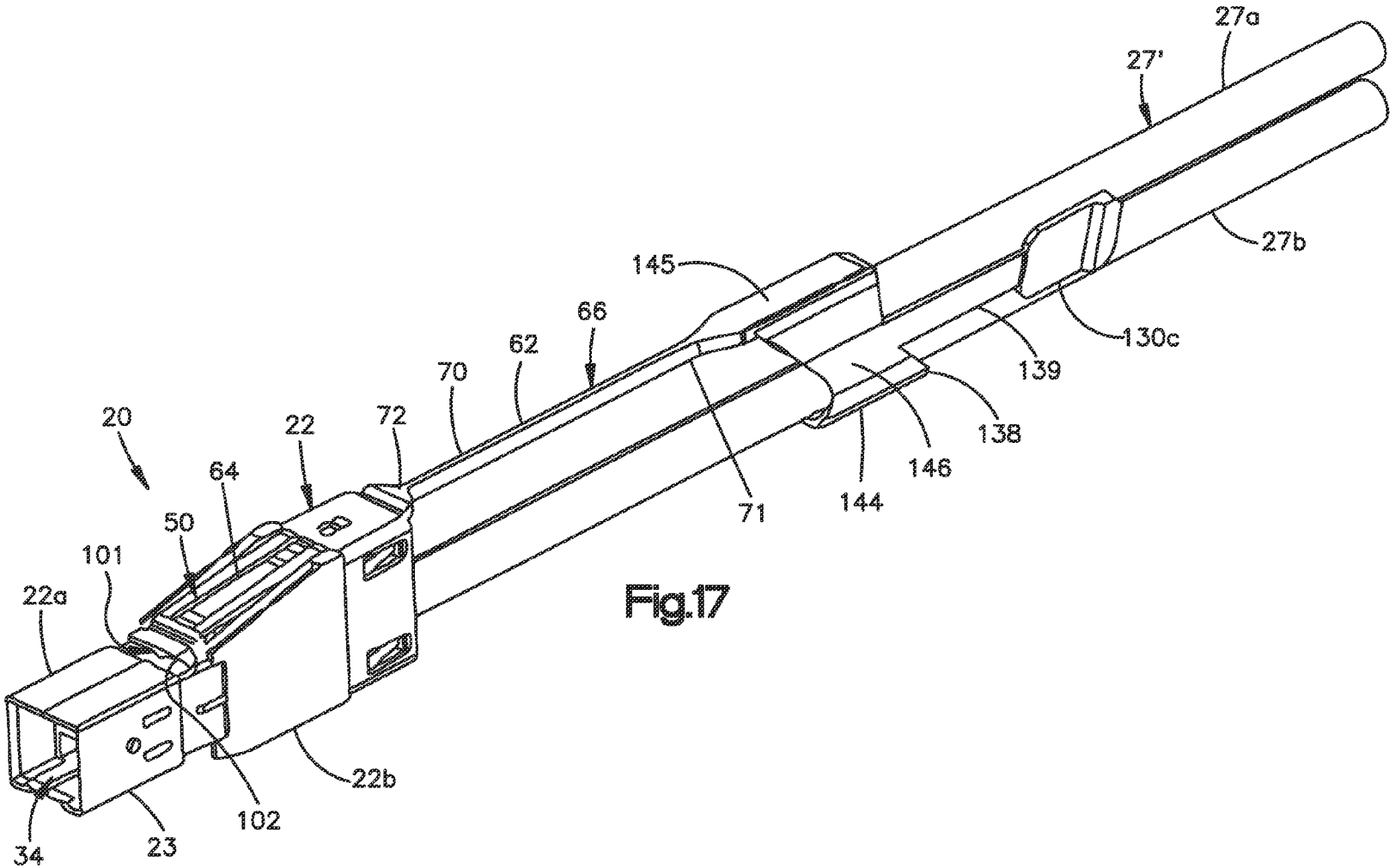
FIG. 17 is a perspective view of an electrical connector similar to the electrical connector illustrated in FIG. 13A, but including a grip portion constructed in accordance with an alternative embodiment.

Referring to FIGS. 16A-B, the pull tab 66 can further include respective arms 139 connected between the band 144, and thus the junction 138, and the grip tabs 130*a-b* (see FIGS. 13A-D). Referring to FIG. 16A, the pull tab 66 can include a lateral grip tab 130*c* alone or in combination with the transverse first and second grip tabs 130*a* and 130*b*. The lateral grip tab 130*c* can, for instance extend from the middle portion 146 of the connection band 144, and extend between the grip tabs 130*a* and 130*b*. Referring to FIG. 16B, the lateral grip tab 130*c* can be a first lateral grip tab, and the pull tab 66 can include a second lateral grip tab 130*d* that is split into first and second grip tab segments 130*d*' and 130*d*" that extend from the cable grips 148*a* and 148*b*, respectively (see also FIG. 14C). The grip tabs 130*c* and 130*d* (and thus segments 130*d*' and 130*d*") can define inner and outer surfaces as described above with respect to the grip tabs 130*a* and 130*b*. The pull tab 66 can further include respective arms 139 connected between the band 144 and the grip tabs 130*c* and 130*d*. In accordance with one embodiment, one of the arms 139 can include arm segments 139' and 139" connected between the cable grips 148*a* and 148*b* and the first and second segments 130*d*' and 130*d*". Thus, the pull tab 66 can include grip tabs 130*c* and 130*d* that are laterally spaced apart, such that the grip tabs 130*c* and 130*d* are disposed on opposed lateral sides of at least one or both of the cables 27*a* and 27*b*, alone or in combination with the first and second grip tabs 130*a* and 130*b*. Accordingly, the grip tabs 130*c* and 130*d* can be elongate in a substantially vertical plane as defined by the longitudinal L and transverse T directions. It should be appreciated that the pull tab 66 can include one or both of the grip tabs 130*c* and 130*d* in combination with the grip tabs 130*a* and 130*b* (see FIG. 16A) or without the grip tabs 130*a* and 130*b* (see FIG. 17).

Figure 13E:
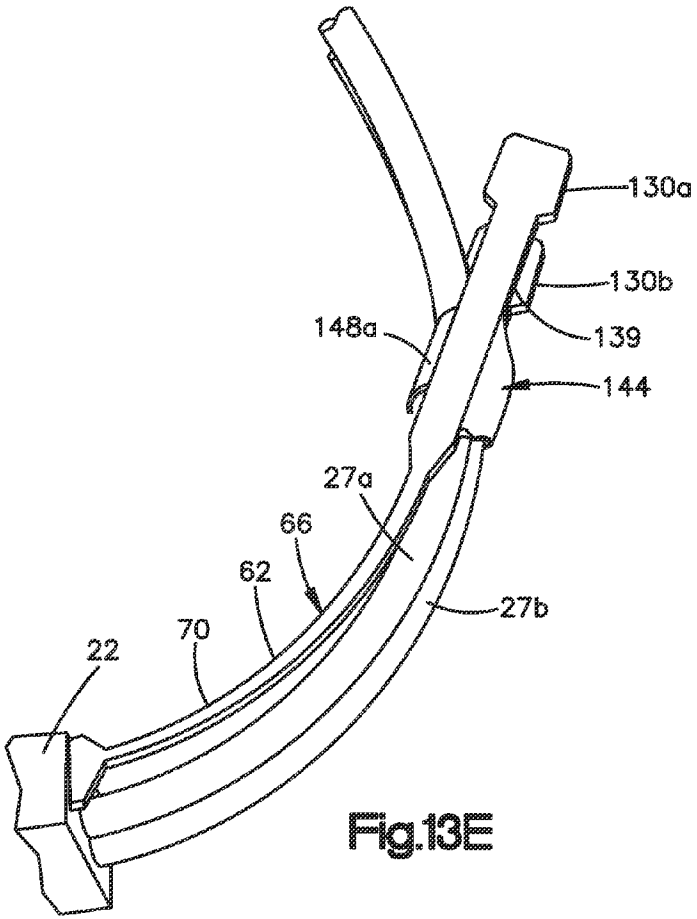
FIG. 13E is a perspective view of the grip portion in FIG. 13D during operation.
Figure 15A:
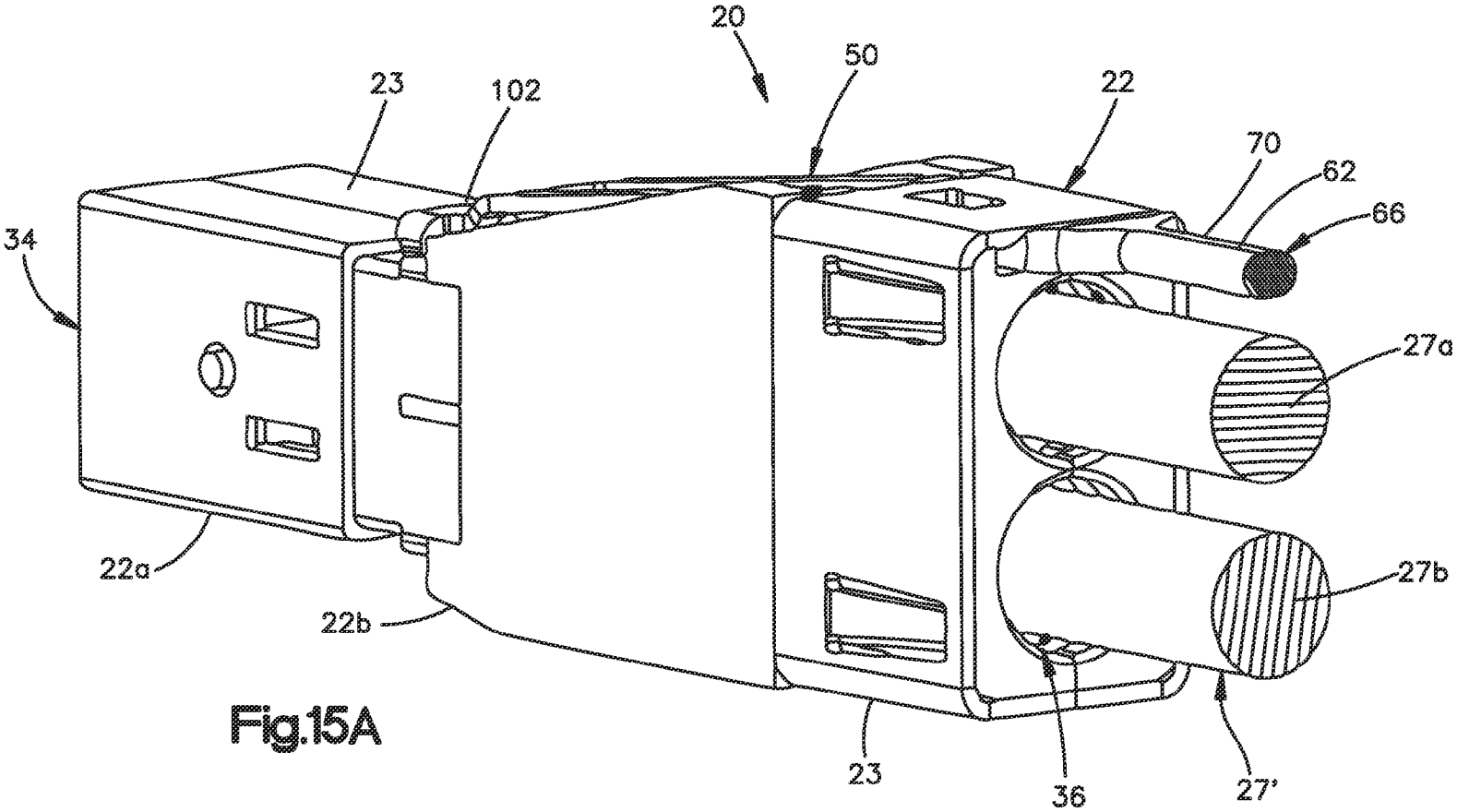
FIG. 15A is a sectional perspective view of the electrical connector illustrated in FIG. 13A, taken along line 15A-15A.
Figure 15B:
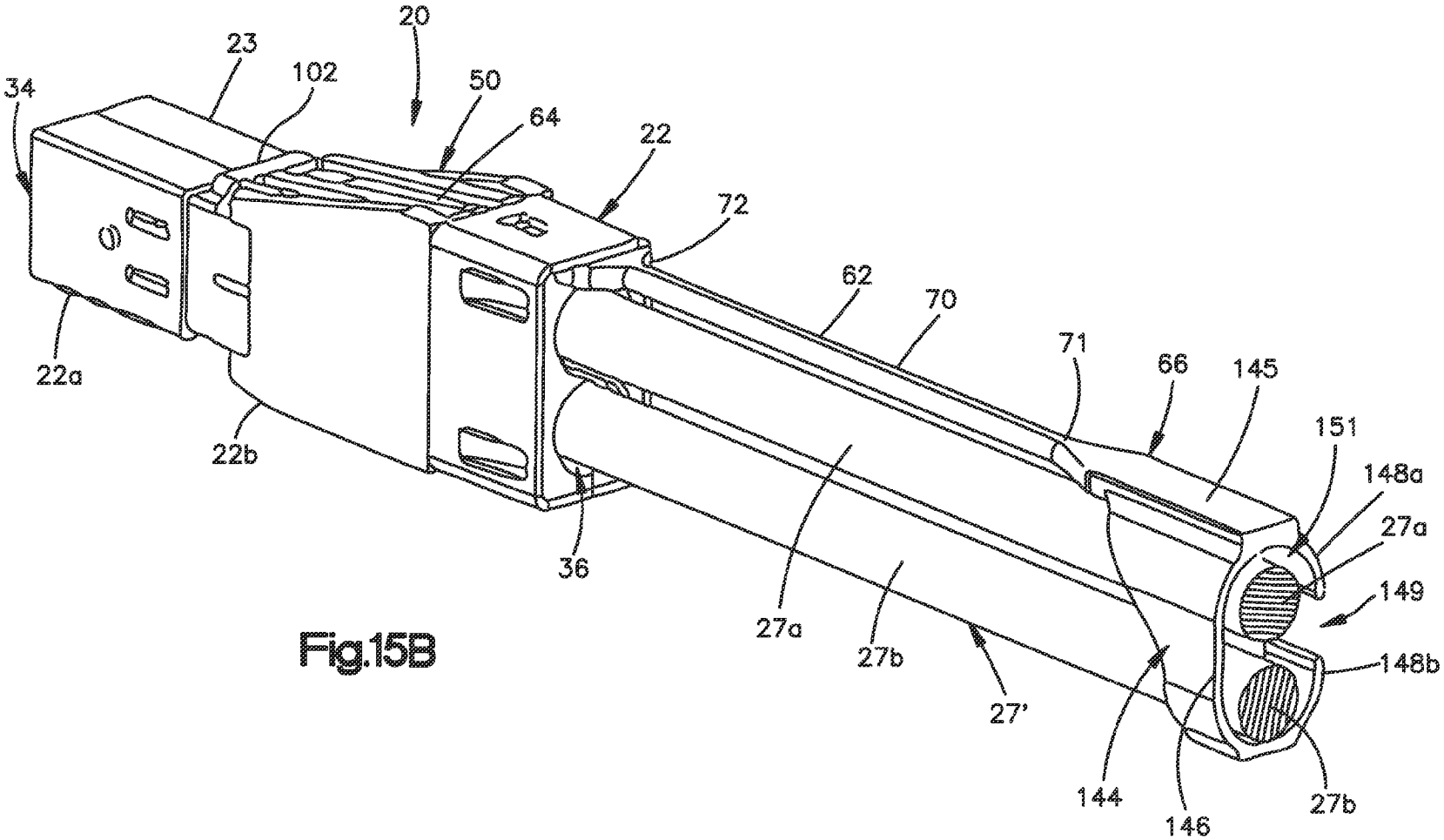
FIG. 15B is a sectional perspective view of the electrical connector illustrated in FIG. 13A, taken along line 15B-15B.

Because the grip tabs 130*a* and 130*b* extend longitudinally rearward from the connection band 144 along the respective cable assembly 27, the user is able to intuitively ascertain the grip tabs 130*a* and 130*b* that are associated with a given electrical connector 20, for instance when a plurality of electrical connectors are mounted onto a common panel in close proximity. Furthermore, as illustrated in FIG. 13E, the connection band 144 can travel along the cable assembly 27 as the cables 27*a* and 27*b* are bent or curved in one or both of the lateral and transverse directions as they are routed from the electrical connector 20 to another electrical component, for instance when the electrical connector is mounted to a panel, such that the grip tabs 130*a* and 130*b* extend out from the connection band 144 in the manner described above. It should thus be appreciated that the pull tab is slidably attached to the cable assembly 27, and slidably receives the cable assembly 27 in accordance with the illustrated embodiment. Accordingly, during operation, the connection band 144 can travel along the cable assembly 27, for instance when an actuating pulling force is applied to one or both of the grip tabs 130*a* and 130*b* when iterating the latch assembly 50 between the latched and unlatched positions.

It should be appreciated that the connection band 144 can be discretely connected or integral with one or more up to all of the grip tabs 130*a* and 130*b* and the arm 70. The connection band 144 can be made from any material as desired, such as a plastic, which can be a flexible plastic, or a metal.

It is appreciated that the components of the pull tab 66 can be integrally fabricated from a unitary flexible material, such as a flexible plastic. The flexible material facilitates bending of the latch arm 70, for instance during operation. It should be further appreciated that the electrical connector 20 has been described in accordance with certain embodiments, and that the electrical connector 20 can be constructed in accordance with alternative embodiments.

The embodiments described in connection with the illustrated embodiments have been presented by way of illustration, and the present invention is therefore not intended to be limited to the disclosed embodiments. Furthermore, the structure and features of each the embodiments described above can be applied to the other embodiments described herein, unless otherwise indicated. For instance, while the latch body 64 and the pull tab 66 are discretely connected in accordance with the illustrated embodiment, the latch body 64 and the pull tab 66 can alternatively be integral with each other. Furthermore, while the latch body 64 is discretely attached to the connector housing 22 in accordance with the illustrated embodiment, it should be appreciated that the latch body can alternatively be integral with the connector housing 22. For instance, the pivot members 99 could be integrally connected to the connector housing 22 such that the latch body 64 can pivot about the pivot members 99 as described above. Additionally, it should be appreciated that the engagement member 101 could be configured as any suitable engagement member configured to latch the electrical connector 20 with the complementary connector when the latch assembly 50 is in the latched position. For instance, the engagement member could alternatively be provided as a catch member instead of a latch member, and can thus be configured to receive a complementary latch member of the complementary electrical connector when the latch assembly 50 is in the latched position. Accordingly, those skilled in the art will realize that the invention is intended to encompass all modifications and alternative arrangements included within the spirit and scope of the invention, for instance as set forth by the appended claims.

What is claimed:

1. An electrical connector comprising:

a connector housing defining a mating interface and an opposed mounting interface disposed at a rear end of the connector housing, and at least one electrical contact supported by the connector housing, the at least one electrical contact configured to mate with a complementary electrical contact of a complementary electrical connector at the mating interface, wherein the connector housing is configured to receive a cable assembly at the mounting interface so as to place the cable assembly in electrical communication with the at least one electrical contact;

a latch body supported by the connector housing and configured to actuate between a latched position and an unlatched position; and an actuator having at least one arm that is attached to the latch body arm, such that movement of the at least one arm in response to an applied actuation force causes the latch body actuate from the latched position to the unlatched position, the actuator further having an actuator portion that extends rearward with respect to the mounting interface, wherein the actuator portion further comprises a pair of grip tabs that are configured to receive the actuation force, and the grip tabs define a cable assembly-receiving gap that is sized to receive the cable assembly to which the electrical connector is mounted.

2. The electrical connector as recited in claim 1, further comprising a spring that provides a spring force that biases the latch member toward the latched position.

3. The electrical connector as recited in claim 2, wherein the spring is integral with the latch body.

4. The electrical connector as recited in claim 1, wherein the connector housing defines an upper surface that supports the at least one latch arm, and a brace that is inwardly offset with respect to the surface, such that the at least one latch arm extends from the upper surface to a location below the brace.

5. The electrical connector as recited in claim 4, wherein the connector housing further defines a tapered ramp surface having a proximal end adjacent the upper surface, the ramp surface extending from its proximal end so as to define a distal surface that is spaced below the proximal end of the ramp surface.

6. The electrical connector as recited in claim 5, wherein the distal surface of the ramp surface is spaced below the brace.

7. The electrical connector as recited in claim 5, wherein the at least one arm extends from the upper surface to a location below the brace.

8. The electrical connector as recited in claim 1, wherein the connector housing define a seat surface, latched position the latch member is biased toward the seat surface, and in the unlatched position the latch member is biased away from the seat surface against the spring force.

9. The electrical connector as recited in claim 8, wherein the spring member extends proximally from the first side of the pivot location against the connector housing so as to bias the latch member against the seat surface.

10. The electrical connector as recited in claim 1, wherein the grip tabs are laterally spaced.

11. The electrical connector as recited in claim 1, wherein the grip tabs are substantially planar.

12. The electrical connector as recited in claim 1, wherein the grip tabs are curved.

13. The electrical connector as recited in claim 1, further comprising a cable grip that extends from each of the grip tabs so as to at least partially wrap around the cable.

14. The electrical connector as recited in claim 13, wherein the cable grips are spaced from each other such that the actuator is discontinuous about the cable.

15. The electrical connector as recited in claim 14, further comprising a junction connected between the grip tabs and the at least one arm, and a reinforcing member that extends about the junction and the cable grip.

16. The electrical connector as recited in claim 15, further comprising a flexible junction connected between the grip tabs, wherein the junction is configured to slidably retain each of the pair of cables.

17. The electrical connector as recited in claim 16, wherein the grip tabs extend rearward with respect to the junction.

18. The electrical connector as recited in claim 17, wherein the arms are connected between the junction and the grip tabs, respectively.

19. The electrical connector as recited in claim 1, wherein the actuator portion further comprises a grip portion that is substantially tubular so as to be substantially continuous about a cable to which the electrical connector is mounted.

20. The electrical connector as recited in claim 19, wherein the grip portion comprises a pair of grip members that are spaced along a length of the cable.

21. The electrical connector as recited in claim 20, further comprising a plurality of circumferentially spaced panels that are connected between each of the pair of grip members.

22. The electrical connector as recited in claim 1, wherein the latch body is pivotally connected to the connector housing at a pivot location, the latch body attached to the at least one arm at a first side of the pivot location, and the latch body includes a latch member disposed at a second side of the pivot location opposite the first side, wherein the movement of the at least one arm causes the latch body to rotate about the pivot axis, thereby moving the latch member away from the connector housing.

* * * * *

UNITED STATES PATENT AND TRADEMARK OFFICE

CERTIFICATE OF CORRECTION

PATENT NO. : 8,585,426 B2
APPLICATION NO. : 13/189380
DATED : November 19, 2013
INVENTOR(S) : Arkady Y. Zerebilov It is certified that error appears in the above-identified patent and that said Letters Patent is hereby corrected as shown below:

In the Claims

COL. 17, line 36 [claim 8], delete "define" and substitute therefor --defines--; before "latched position" insert --in the--.

Signed and Sealed this
Twenty-fifth Day of February, 2014

Michelle K. Lee

Michelle K. Lee
*Deputy Director of the United States Patent and Trademark Office*